US007521870B2

(12) United States Patent
Watanabe et al.

(10) Patent No.: US 7,521,870 B2
(45) Date of Patent: Apr. 21, 2009

(54) LUMINOUS CONTAINERS AND THOSE FOR HIGH PRESSURE DISCHARGE LAMPS

(75) Inventors: Keiichiro Watanabe, Kasugai (JP); Takashi Ohta, Kasugai (JP); Naoki Masui, Kounan (JP)

(73) Assignees: NGK Insulators, Ltd., Nagoya (JP); NGK Optoceramics Co., Ltd., Komaki (JP)

( * ) Notice: Subject to any disclaimer, the term of this patent is extended or adjusted under 35 U.S.C. 154(b) by 687 days.

(21) Appl. No.: 11/144,369

(22) Filed: Jun. 3, 2005

(65) Prior Publication Data

US 2006/0022596 A1 Feb. 2, 2006

Related U.S. Application Data

(60) Provisional application No. 60/604,319, filed on Aug. 25, 2004.

(30) Foreign Application Priority Data

Jun. 8, 2004 (JP) ..... P2004-169497
Aug. 11, 2004 (JP) ..... P2004-234670

(51) Int. Cl.
*H01J 1/88* (2006.01)

(52) U.S. Cl. ..... 313/623; 313/285

(58) Field of Classification Search ..... 313/623–625, 313/283–290, 253, 252, 244, 243
See application file for complete search history.

(56) References Cited

U.S. PATENT DOCUMENTS 3,531,853 A 10/1970 Klomp
3,564,328 A 2/1971 Bagley et al.
3,848,151 A 11/1974 McVey
4,011,480 A 3/1977 Jacobs et al.
4,376,905 A 3/1983 Kerekes
4,459,509 A 7/1984 Csapody et al.
4,746,582 A 5/1988 Tsuno
4,803,403 A 2/1989 Makar, Jr. et al.
5,404,077 A 4/1995 Eichelbrönner et al.
6,027,389 A 2/2000 Miyazawa et al.
6,262,533 B1 7/2001 Niimi
2004/0086298 A1 5/2004 Ojima et al.
2005/0236960 A1 * 10/2005 Kupper et al. ..... 313/489

FOREIGN PATENT DOCUMENTS

GB 1 435 244 5/1976

(Continued)

OTHER PUBLICATIONS

U.S. Appl. No. 11/391,945, filed Mar. 29, 2006, Watanabe et al.

*Primary Examiner*—Nimeshkumar D. Patel
*Assistant Examiner*—Christopher M Raabe
(74) *Attorney, Agent, or Firm*—Burr & Brown

(57) ABSTRACT

A luminous container has an electrode supporting member composed of a pipe-shaped metal piece. The electrode supporting member 8 has a clamped portion pressed and clamped with and non-clamped portions not clamped with a brittle material. The stress generated along a contact interface of the clamped portion and the brittle material is relaxed with the deformation of the electrode supporting member.

32 Claims, 34 Drawing Sheets

FOREIGN PATENT DOCUMENTS

| | | |
|---|---|---|
| JP | 41-7815 | 4/1966 |
| JP | 45-10627 | 5/1970 |
| JP | 50-45482 | 4/1975 |
| JP | 50-78175 | 6/1975 |
| JP | 51-72187 | 6/1976 |
| JP | 52-080675 | 7/1977 |
| JP | 56-128561 | 10/1981 |
| JP | 57-046562 | 3/1982 |
| JP | 57-145261 | 9/1982 |
| JP | 60-59352 | 4/1985 |
| JP | 62-182174 | 8/1987 |
| JP | 63-159264 | 7/1988 |
| JP | 63-259958 | 10/1988 |
| JP | 05 205701 | 8/1993 |
| JP | 06-296107 | 10/1994 |
| JP | 07-33294 | 4/1995 |
| JP | 10-125230 | 5/1998 |
| JP | 11-149902 | 6/1999 |
| JP | 11-265686 | 9/1999 |
| JP | 2004-134219 | 4/2004 |
| JP | 2004-149640 | 5/2004 |
| JP | 2004-163911 | 6/2004 |

* cited by examiner

LUMINOUS CONTAINERS AND THOSE FOR HIGH PRESSURE DISCHARGE LAMPS

CROSS-REFERENCE TO RELATED APPLICATIONS

This application claims the benefit of Japanese patent application 2004-169497, filed on Jun. 8, 2004, Japanese patent application 2004-234670, filed on Aug. 11, 2004, and U.S. patent application 60/604,319, filed on Aug. 25, 2004, the entireties of which are incorporated by reference.

FIELD OF THE INVENTION

The present invention relates to a luminous container suitable for use in a high pressure discharge lamp or the like.

BACKGROUND OF THE INVENTION

According to a luminous container for a high pressure discharge lamp described in Japanese patent publication 10-125230A, a molded body for a main body of a tube and a ring-shaped sealing member for the end portion are separately produced, and the two kinds of the molded bodies are assembled to produce an assembly. The assembly is then sintered to produce a container for sealing metal halide. In the process, the sintering shrinkages of both molded bodies are designed so that the outer diameter of the sintered body of the molded body for the sealing member for the end portion is larger than the inner diameter of the molded body for the main body for the tube, if each of the molded bodies would have been sintered alone. During the sintering, a clamping force is applied from the main body of the tube toward the sealing member for the end portion so that both sintered bodies are bonded in good manner to preserve excellent air-tightness.

For example, according to a luminous container for a high pressure discharge lamp listed in Japanese patent publication 10-125230A, a ring-shaped sealing member is pressed onto the end portion of the luminous vessel and an electrode member is inserted into a through hole of the sealing member. The sealing member is made of a cermet and the luminous vessel is made of a ceramic material such as alumina. The molded body for the sealing member is fixed in the opening in the end portion of the molded body for luminous vessel, and the molded bodies are then sintered to shrink them. In this process, it is designed that the shrinkage percentage of the luminous vessel is made larger than that of the sealing member. It is thus possible to generate compressive force from the luminous tube toward the sealing member to fix the sealing member in air-tight manner. A metal electrode member is inserted into the opening of the sealing member to seal the sealing member and electrode member in air-tight manner.

SUMMARY OF THE INVENTION

According to the method of sealing the end portion as described in Japanese patent publication 10-125230A, metal welding cannot be applied for sealing the sealing and electrode members, so that glass or metal oxide cement has been used for the sealing. Glass or metal oxide cement is relatively weak against a corrosion substance such as metal halide gas at high temperature and susceptible to corrosion. Further, these materials are susceptible to fracture by many times of thermal cycles of high and low temperatures and thus have a limitation in the reliability.

An object of the present invention is to provide a luminous container for sealing a luminous substance in a brittle material in air-tight manner and alleviating the necessity of the direct contact of the sealing material with a corrosive substance.

A first aspect of the present invention provides a luminous container comprising an electrode supporting member comprising a plate-shaped metal piece preferably having a shape of a seamless cylinder, said electrode supporting member comprising a clamped portion pressed and clamped with and a non-clamped portion not clamped with a brittle material, wherein a stress generated along an interface of the clamped portion and brittle material is relaxed by the deformation of the electrode supporting member.

Further, a first aspect of the present invention provides a luminous container for a high pressure discharge lamp comprising the luminous vessel, an electrode and a current through conductor both supported by the electrode supporting member.

A second aspect of the present invention further provides a luminous container comprising an outer supporting body comprising a tube-shaped portion of a brittle material, an inner supporting body provided inside of said outer supporting body and made of a brittle material, and a plate-shaped metal piece provided between said outer supporting body and said inner supporting body. The outer supporting body and the plate-shaped metal piece directly contact each other, the plate-shaped metal piece and the inner supporting body directly contact each other and the outer supporting body and the inner supporting body directly contact each other.

A second aspect of the present invention further provides a luminous container comprising an inner supporting body comprising a tube-shaped portion made of a brittle material, an outer supporting body provided outside of said inner supporting body and made of a brittle material, and a plate-shaped metal piece provided between said inner and outer supporting bodies. The inner supporting body and the plate-shaped metal piece directly contact each other, the plate-shaped metal piece and the outer supporting body directly contact each other and the inner supporting body and the outer supporting body directly contact each other.

The aspect of the present invention further provides a luminous container for a high pressure discharge lamp having the luminous container, a current through conductor and an electrode both supported by the electrode supporting member.

Accordingly, the luminous container of the present invention, an electrode supporting member composed of a plate-shaped metal piece is pressed with a brittle material so as to seal luminous substance in air-tight manner. Such structure does not require frit glass and cement materials directly contacting the luminous substance essential for prior structures, so that the resulting luminous container is expected to have improved corrosion resistance against the luminous substance.

Further, according to the luminous container of the third aspect, it is provided an outer supporting body comprising a ceramics or cermet, an inner supporting body comprising a ceramic or a cermet, and a clamped portion of a plate-shaped metal piece sandwiched by the outer and inner supporting bodies, so that the clamped portion of the plate-shaped metal piece is pressed by the outer and inner supporting bodies. It is thus possible to pressure bond the metal piece with cermet or ceramics to provide a novel structure, preferably for air-tight sealing. According to prior arts, it is known as a pinch seal, in which a metal foil is inserted into an opening at the end of a glass container and the glass is soften and deformed to provide air-tight sealing using the metal foil. It has not been known to provide air-tight sealing using brittle materials such as ceramics or cermet which is resistive to softening and deformation.

The brittle material for pressing the electrode supporting member or forming the main body of the luminous container is not particularly limited according to the present invention, and includes glass, ceramics, single crystal and cermet.

Such glass includes quartz glass, aluminum silicate glass, borosilicate glass, silica-alumina-lithium series crystallized glass etc.

The ceramics includes, for example, ceramics having corrosion resistance against a halogen series corrosive gas, and may preferably be alumina, yttria, yttrium-aluminum garnet, aluminum nitride, silicon nitride or silicon carbide. Single crystals of any of the materials selected from the above may be used.

The cermet may be composite materials of a ceramics such as alumina, yttria, yttrium-aluminum garnet and aluminum nitride and a metal such as molybdenum, tungsten, hafnium and rhenium.

The single crystal includes those being optically transparent in visual ray band, such as diamond (single crystal of carbon) or sapphire (Al2O3 single crystal).

According to the present invention, the electrode supporting member made of the plate-shaped metal piece and preferably having a shape of a seamless cylinder has a clamped portion pressed and clamped with a brittle material and a non-clamped portion not pressed and not clamped with the brittle material. The brittle material clamping the plate-shaped metal piece may be a luminous vessel or a plug member fixed in the inside of an end portion of a luminous vessel. Alternatively, the brittle material may be a clamping member fixed to the outside of the end portion of the luminous vessel. Further, outer and inner supporting bodies each made of a brittle material separate from the luminous vessel may be prepared to clamp the plate-shaped metal piece between the outer and inner supporting bodies, so that the outer and inner supporting bodies are bonded to the luminous vessel.

According to the present invention, the plate-shaped metal material may preferably be pressed and clamped at both sides in the direction of thickness with brittle materials having thermal expansion coefficients being substantially equivalent or same with each other. It is thus possible to avoid the generation of stress between the opposing brittle material portions. Stress generated in the metal member provides substantially equivalent distribution with respect to the central plane passing through the center of the metal member in the direction of thickness. Further, the metal member has a thickness considerably smaller than that of the brittle material, so that the stress generated in the metal member is relaxed by the plastic deformation of the metal. It is thus possible to avoid the possibility of critical damages such as bending and crack formation of the metal member or considerable deformation, after the press clamping while under temperature change conditions.

According to the present invention, the stress generated along the contact interface between the clamped portion and the brittle material is relaxed due to the deformation of the plate-shaped metal piece.

The stress along the contact interface of the clamped portion and brittle material is generated, for example, due to the following mechanism. The thermal expansion coefficient of the metal material is represented by "$\alpha 1$", the Young's modulus of the metal is represented by "E1", the thermal expansion coefficient of the brittle material is represented by "$\alpha 2$" and the Young's modulus of the brittle material is represented by "E2". It is now provided that the metal material is embedded in the brittle material, and the brittle material is then sintered at a sintering temperature "T1" and cooled to room temperature so that the metal material is pressed and clamped with the brittle material. In this case, it is provided that both materials would not be deformed and would not slide along the interface, the stress "$\alpha 1$" generated in the metal is represented by the following formula.

$$\sigma 1 \propto E1 \times (T1 - \text{room temperature}) \times (\alpha 1 - \alpha 2) \quad (1)$$

The stress "$\alpha 2$" generated in the brittle material is similarly represented by the formula.

$$\sigma 2 \propto E2 \times (T1 - \text{room temperature}) \times (\alpha 2 - \alpha 1) \quad (2)$$

The combination of molybdenum and alumina is taken for the example, the thermal expansion coefficient and Young's modulus of molybdenum are about 5 ppm/° C. and about 330 GPa, respectively. The thermal expansion coefficient and Young's modulus of alumina are about 8 ppm/° C. and about 360 GPa, respectively. For example, when alumina is sintered at 1500° C. and then cooled to room temperature, a compressive stress of about 1500 MPa is generated in molybdenum, provided that there is not plastic deformation of molybdenum. Similarly, a tensile stress of about 1600 MPa is generated in alumina.

Both of the stress values are beyond the strengths of the corresponding materials, so that such composite structure cannot be produced because of the fracture along the interface of the brittle material and metal.

However, a stress generated in the metal beyond the yield strength of the metal results in the plastic deformation. The magnitude of the deformation until the fracture is represented by the elongation. Such elongation generally takes a considerably large value of several percent to several tens percent.

According to the present invention, the thickness of the metal material is made relatively smaller than that of the ceramic material, so as to generate a stress larger than the yield strength of the metal to cause the plastic deformation, so that the overall stress generated due to the difference of the thermal expansion coefficients is relaxed.

For example, it is provided that the metal member is made of a thin plate of molybdenum having a thickness of 100 micrometer, and the ceramic block is made of alumina having a thickness of 10 mm, the strain in the molybdenum plate required for deforming the molybdenum plate and for relaxing the stress is represented by the following formula (3).

$$\epsilon = (T1 - \text{room temperature}) \times (\alpha 1 - \alpha 2) \approx 0.5\% \quad (3)$$

The amount of deformation in the direction of the thickness is represented by the formula.

$$\Delta t = \epsilon \times t \approx 0.5 \text{ micrometer} \quad (4)$$

It is thus possible to relax the overall stress by a considerably small amount of deformation.

The combination of platinum and alumina is taken for example, the thermal expansion coefficient and Young's modulus of platinum are about 9 ppm/° C. and about 170 GPa, respectively, and the thermal expansion coefficient and Young's modulus of alumina are about 8 ppm/° C. and about 360 GPa, respectively. For example, when alumina is sintered at 1500° C. and then cooled to room temperature, a tensile stress of about 250 MPa is generated in platinum member provided that no plastic deformation is generated in platinum. Similarly, a compressive stress of about 530 MPa is to be generated in the alumina member.

Also in this case, when the platinum member is made of a thin plate having a thickness of 100 mm and the alumina member is made of a block having a thickness of 10 mm, the strain in the platinum member required for deforming the platinum thin plate and for relaxing it is represented by the above formula (3) and about 0.1 percent in this case. Although a tensile stress is generated in the platinum member in the direction of the pressing and clamping, only 0.1 percent of deformation in the direction of the depth of the platinum plate can relax the tensile stress. The amount of deformation is only 10 μm, provided that the depth of the pressing and clamping is 10 mm.

As described above, the stress is generated mainly due to the difference of thermal expansion coefficients of the brittle and metal materials in the composite structure of the materials and thus reflects a strain of about 1 percent or lower. On the other hand, the yield strength of the metal material is lower than the tensile strength and the elongation required for the fracture is several percent to several tens percent. The thickness of the metal material is made relatively smaller than that of the brittle material so as to generate a stress larger than the yield strength of the metal to cause the plastic deformation for relaxing the difference of the thermal expansion coefficients. Even in this case, the amount of deformation is in a range of the elongation so that the fracture of the metal material is avoided. Further, the metal material is deformed to relax the stress generated in the brittle material to provide a composite structure of the brittle material and metal. When the materials are integrated utilizing sintering shrinkage requiring thermal process at a high temperature, the relaxing of the stress can be performed also due to deformation of the metal material such as high temperature creep.

According to a preferred embodiment, the difference of the thermal expansion coefficients of the brittle materials on the both side of the plate-shaped metal piece may preferably be 2 ppm or lower and more preferably be 1 ppm or lower. Most preferably, the thermal expansion coefficients are the same. The thermal expansion coefficients of the both brittle materials may be thus adjusted to further improve the stability and reliability of the inventive structure of brittle material and metal against thermal cycles.

According to a preferred embodiment, brittle materials on the both sides for pressing and clamping the clamped portion of the plate-shaped metal piece is composed of sintered bodies having different sintering shrinkages, so that the plate-shaped metal piece is pressure bonded with the difference of shrinkage during the sintering process. A preferred value of the difference of shrinkages will be described below.

Alternatively, according to a preferred embodiment, brittle materials on the inner side for pressing the material of the clamped portion of the plate-shaped metal piece may be selected from those not subjected to sintering shrinkage such as a sintered body, a single crystal and glass, and the outer brittle material may be composed of a molded body subjected to sintering shrinkage.

According to a preferred embodiment, the thickness of the plate-shaped metal piece may preferably be 1000 μm or smaller, and more preferably be 200 μm or smaller. The thickness of the plate-shaped metal piece may be made smaller as described above, to cause the deformation of the metal piece. It is thus possible to reduce the stress generated between the metal piece and brittle material and to further improve the air-tightness of the structure. If the plate-shaped metal piece is too thin, however, the strength as the structural body tends to be insufficient. On the viewpoint, the thickness of the metal piece may preferably be 20 μm or larger, and more preferably be 50 μm or larger.

According to a preferred embodiment, the outer brittle material pressing and clamping the clamped portion of the plate-shaped metal piece has a thickness of 0.1 mm or larger. It is thus possible to sufficiently increase the pressure from the brittle material onto the plate-shaped metal piece radially, so as to further improve the air-tightness of the luminous container. On the viewpoint, the thickness of the outer brittle material may preferably be 0.5 mm or larger.

The material and shape of the plate-shaped metal piece is not particularly limited. The material of the metal piece may preferably be a metal having a high melting point. Such metal having a high melting point includes one or more metal(s) selecting from the group consisting of molybdenum, tungsten, rhenium, hafnium, niobium and tantalum, or the alloy containing the metal(s). Further, metal parts other than the plate-shaped metal piece such as the cylindrical portion, ring-shaped portion and capillary portion may be made of the above metal(s) listed for the plate-shaped metal piece.

DETAILED DESCRIPTION OF THE INVENTION

The present invention will be described concerning the examples, referring to the attached drawings below.

Figure 1:
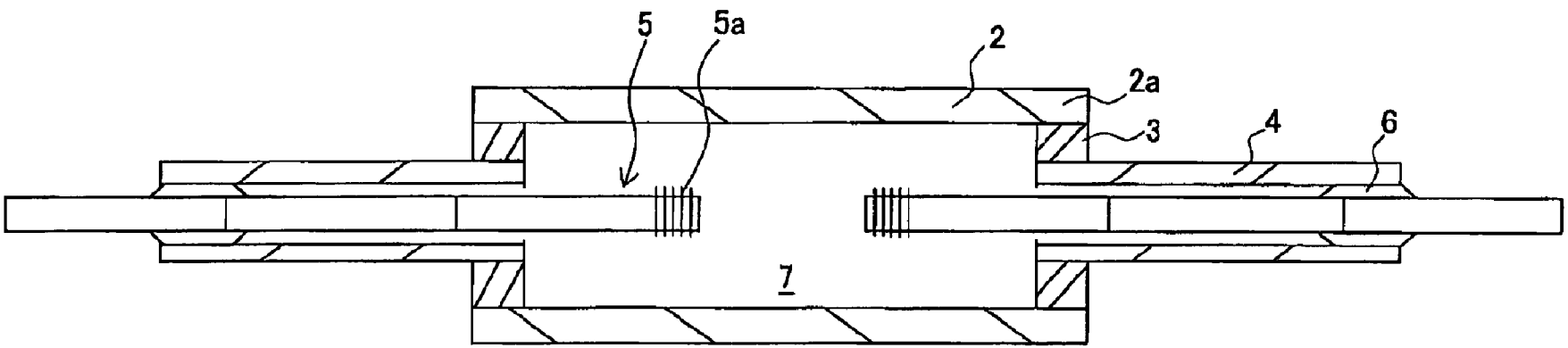
FIG. 1 is a cross sectional view schematically showing a cylindrical type luminous container of a prior art.

FIG. 1 is a cross sectional view schematically showing a luminous container of a prior art, and FIGS. 2 to 8 are cross sectional views schematically showing luminous containers each using a luminous vessel of so called cylindrical type.

As shown in FIG. 1, an alumina supporting tube 4 is fixed onto the inner wall surface 2*a* of a luminous vessel 2 having a shape of a straight tube at both ends through a sealing member 3 made of alumina. The supporting tube 4 and a current through conductor 5 are sealed with a sealing material 6 composed of glass frit or the like. According to the structure, luminous substance at high temperature filled in an inner space 7 of a luminous vessel 2 contacts the sealing material 6, so that the corrosion of the sealing member 6 tends to result in a problem in the structure.

Further, although niobium may preferably be applied as the material of the current through conductor 5 having a thermal expansion coefficient near that of a ceramic (alumina), niobium is susceptible to the corrosion by a luminous substance and thus problematic. Therefore, the current through conductor and electrode may be made of three kinds of materials such as niobium-molybdenum-tungsten or niobium-cermet (a composite sintered body of molybdenum and alumina)-tungsten, the sealing of the electrode may be made at the niobium portion and further the niobium portion may be sealed with a frit material so that the frit material covers a part of accurately controlled portion of molybdenum or cermet for protecting the niobium portion. It is thus possible to relax the thermal stress and prevent the corrosion of niobium.

The electrode rod consisting of three kinds of materials creates high production costs and the need for accurate control of the sealing position of the frit material, so that increased production time is required.

Figure 2:
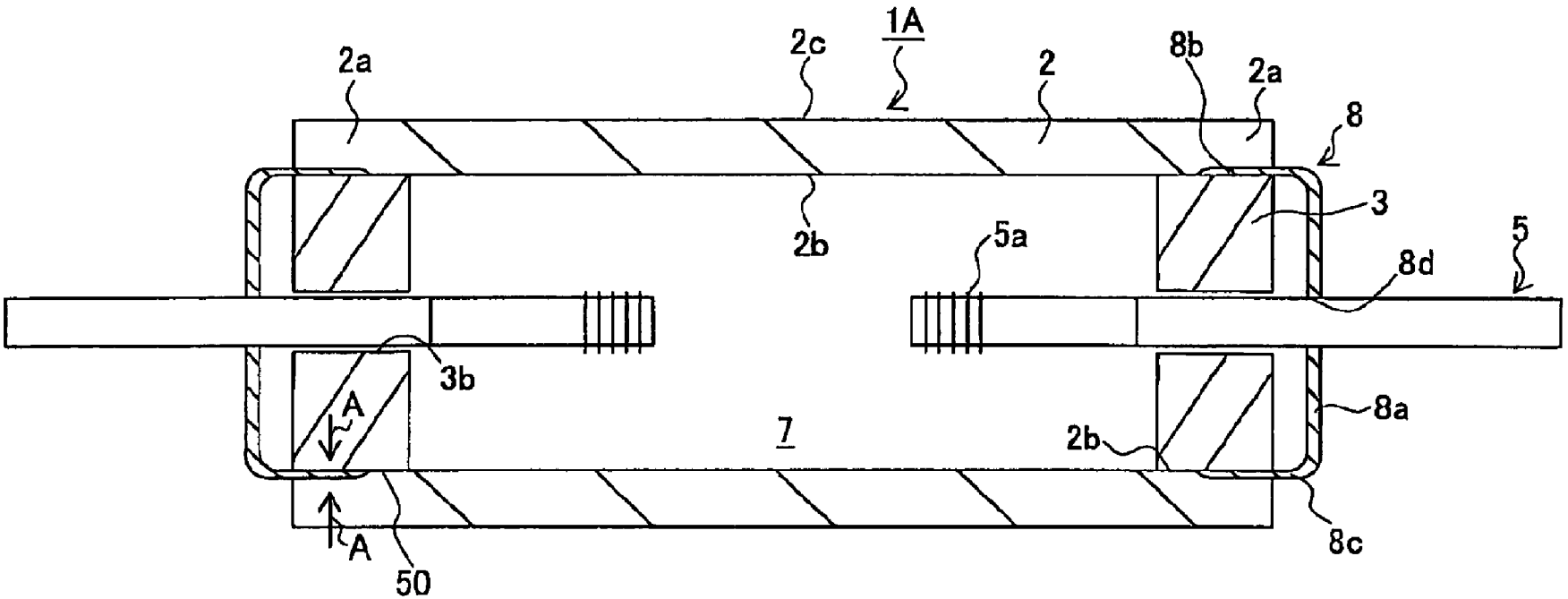
FIG. 2 is a cross sectional view schematically showing a cylindrical type luminous container 1A.

According to a luminous container 1A shown in FIG. 2, a cylindrical luminous vessel 2 made of a brittle material functions as an outer supporting body at the end 2*a* of the luminous vessel, and an inner supporting body 3 made of a brittle material has the analogous shape of a cylinder as the outer supporting body. A clamped portion 8*b* of the plate-shaped metal piece 8 is clamped and fixed between the luminous container 2 and inner supporting body 3. The plate-shaped metal piece 8 functions as a supporting member for the current through conductor 5 and electrode 5*a*. The plate-shaped metal piece may preferably have a seamless and integrated structure for obtaining air-tightness of the luminous vessel. Non-clamped portions 8*a* and 8*c* are protruded from the brittle material, and the clamped portion 8*b* is embedded in the brittle material. Both faces of the clamped portion 8*b* is pressed as shown in an arrow "A" direction to deform the clamped portion 8*b* and to relax the stress due to the difference of physical properties of the brittle material and metal. Further, the luminous vessel 2 and inner supporting body 3 directly contact each other at an interface 50 direct under the clamped portion 8*b*.

8*a* has a shape of a disk and functions as a cover or a cap. A curved part 8*c* is formed between the cover 8*a* and clamped portion 8*b*. A hole 8*d* is formed in the cover 8*a* for passing the electrode 5*a* and current through conductor 5. The hole 8*d* is utilized to supply luminous substances or gas to be sealed into the luminous container, the electrode and current through conductor are then inserted and connected with the cap-like metal piece to assemble the luminous vessel by means of welding, soldering or the like. According to the present example, although the non-clamped portion has a structure of a cover continuously formed from the clamped portion, the shape is not limited and may be appropriately selected depending on the method or state of the connection with the current through conductor.

If molybdenum material having excellent corrosion resistance is used for the cap-like metal piece and current through conductor, the current through conductor and electrode can be formed with two kinds of materials of molybdenum and tungsten. Therefore the requirement to make the current through conductor and electrode of three kinds of materials of niobium-molybdenum-tungsten or niobium-cermet (composite sintered body of molybdenum and alumina)-tungsten is removed. Further the accurate control of the sealed positions with frit material is unnecessary.

Preferably, in FIG. 2, the sintering shrinkage of the luminous vessel 2 as the outer supporting body is made larger than that of the inner supporting body 3. For this, for example shown in FIG. 3, the bodies 2A, 3A to be sintered and plate-shaped metal piece 8 are assembled.

The inner diameter of the body 3A to be sintered for the inner supporting body 3 is designed substantially same as the outer diameter of the current through conductor, so that the positioning accuracy of the electrode can be improved to prevent the corrosion of the side face of the current through conductor and the inner surface of the electrode supporting member. In this case, the diameter of winding part 5*a* of a tungsten coil at the tip end of the electrode is made larger than the inner diameter of the inner supporting body, so that it may be impossible to insert the electrode from the outside of the luminous container. In this case, the electrode and current through conductor are inserted in the inner space in advance in the assembling stage of the bodies to be sintered for the electrode supporting member and inner supporting body. The bodies 2A, 3A and plate-shaped metal piece 8 may be then assembled.

Specifically, the body 2A to be sintered for the luminous vessel is made of ceramic powder. The ceramic powder may contain an additive such as an organic binder or sintering aid. Further, the body 2A to be sintered may be a molded body of the powder, or the calcined body or dewaxed body of the molded body. It is required, however, that the body to be sintered is shrunken after the sintering process.

The body 3A to be sintered for the inner supporting body is made of ceramic powder or mixture of ceramic powder and metal powder for cermet. The powder may contain an additive such as an organic binder or sintering aid. Further, the body 3A to be sintered may be a molded body of the powder, or the calcined body or dewaxed body of the molded body. It is required, however, that the body 2A to be sintered has a sintering shrinkage larger than that of the body 3A to be sintered.

The material of the body 3A to be sintered may be selected from materials whose densification is already complete such as a sintered body, single crystal glass or the like.

Figure 3:
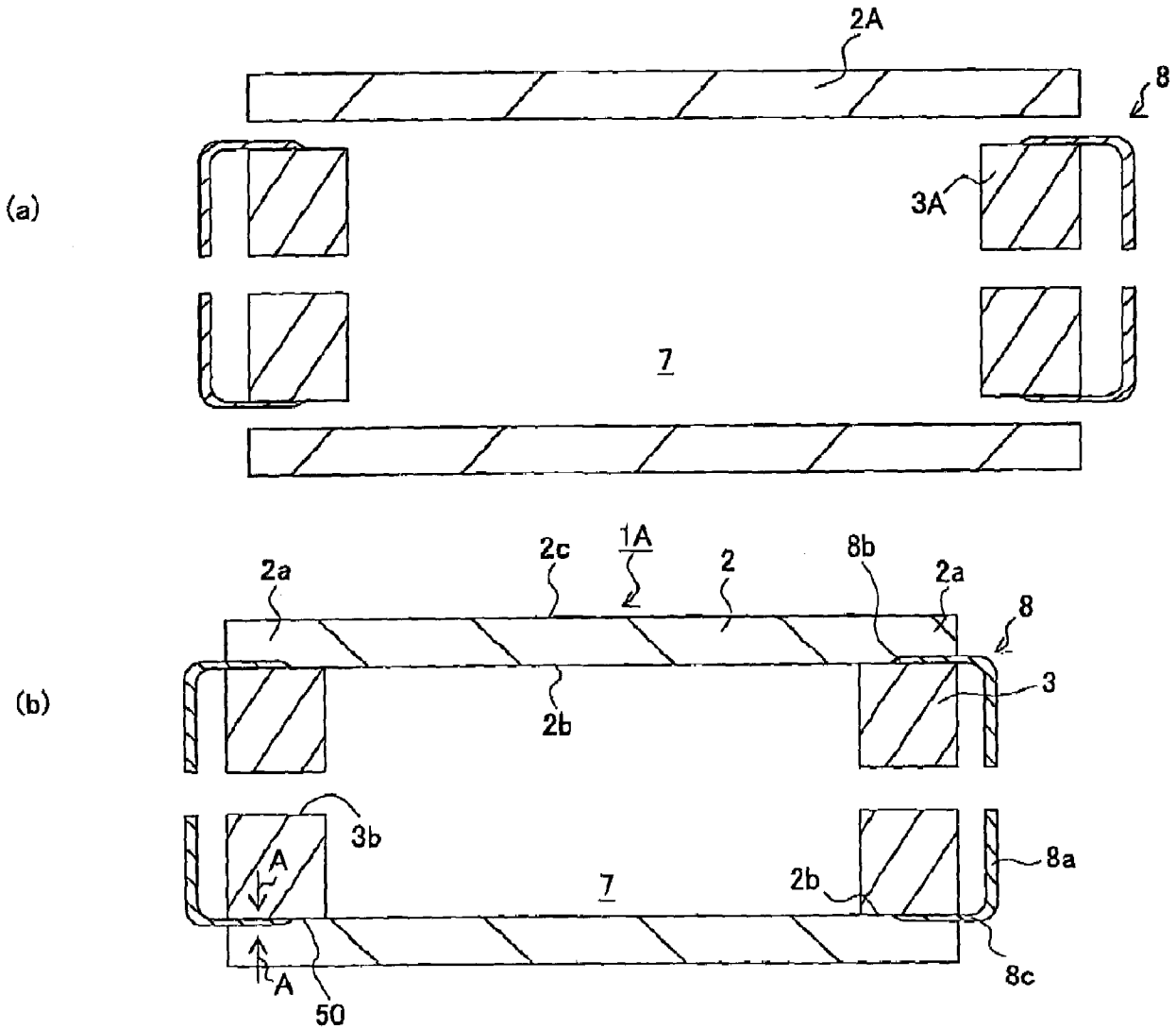
FIG. 3 (*a*) is a cross sectional view schematically showing an assembly for producing the luminous container 1A, and FIG. 3 (*b*) is a cross sectional view showing a luminous container obtained by sintering the assembly of FIG. 3 (*a*).

At the time point of FIG. 3 (*a*) (before sintering), clearances are formed between the body 2A to be sintered and the electrode supporting member 8 and between the electrode supporting member 8 and the body 3A to be sintered. The clearance between the electrode supporting member 8 and the body 3A to be sintered for the inner supporting body may preferably be made smaller than that of the electrode supporting member and the body to be sintered for the outer supporting body. It is thus possible to adhere the supporting member to the inner supporting body with reference to the position of the inner supporting member having a smaller shrinkage, so that the electrode supporting member is clamped more stably.

The bodies 2A and 3A to be sintered are then sintered to densify them. As shown in FIG. 3 (*b*) (after the sintering), the luminous vessel 2 and inner supporting body 3 having the smaller diameter are generated. The luminous vessel 2 and inner supporting body 3 directly contact each other along an interface 50 so that they are integrated microstructurally.

During the sintering step, the outer diameter of the resulting sintered body of the body 2A for the outer supporting body is made larger than the inner diameter of sintered body of the body 3A for the inner supporting body, if each of the bodies would have been subjected to sintering alone. It is thus possible to apply a pressing force from the luminous vessel and the inner supporting body to the clamped portion 8*b* of the electrode supporting member 8 during the sintering, so as to improve the adhesion and air-tightness.

On the viewpoint, the ratio (RO/RI) may preferably be 1.04 or higher and more preferably be 1.05 or higher, provided that "RO" represents the outer diameter of the sintered body obtained by sintering the body for the inner supporting body alone and "RI" represents the inner diameter of the sintered body obtained by sintering the body for the outer supporting body alone.

If "RO/RI" is too larger, cracks tend to be generated in the outer or inner supporting body. On the viewpoint, "RO/RI" may preferably be 1.20 or lower and more preferably be 1.15 or lower.

For example, a knife edge-shaped portion is provided at the tip end of the clamed portion. Alternatively, a C-plane or an R-plane is provided at the tip end of the clamped portion. It is thus possible to improve the wettability of the brittle material and the metal piece at the contact point at the tip end of the clamped portion. When a corner (sharp portion) is left at the tip end of the clamped portion, microcracks may be observed starting from the corner in some samples. However, such cracks are not observed by applying the knife edge, C plane or R plane shape at the tip end of the clamped portion, resulting in a reduction of the stress.

Figure 4:
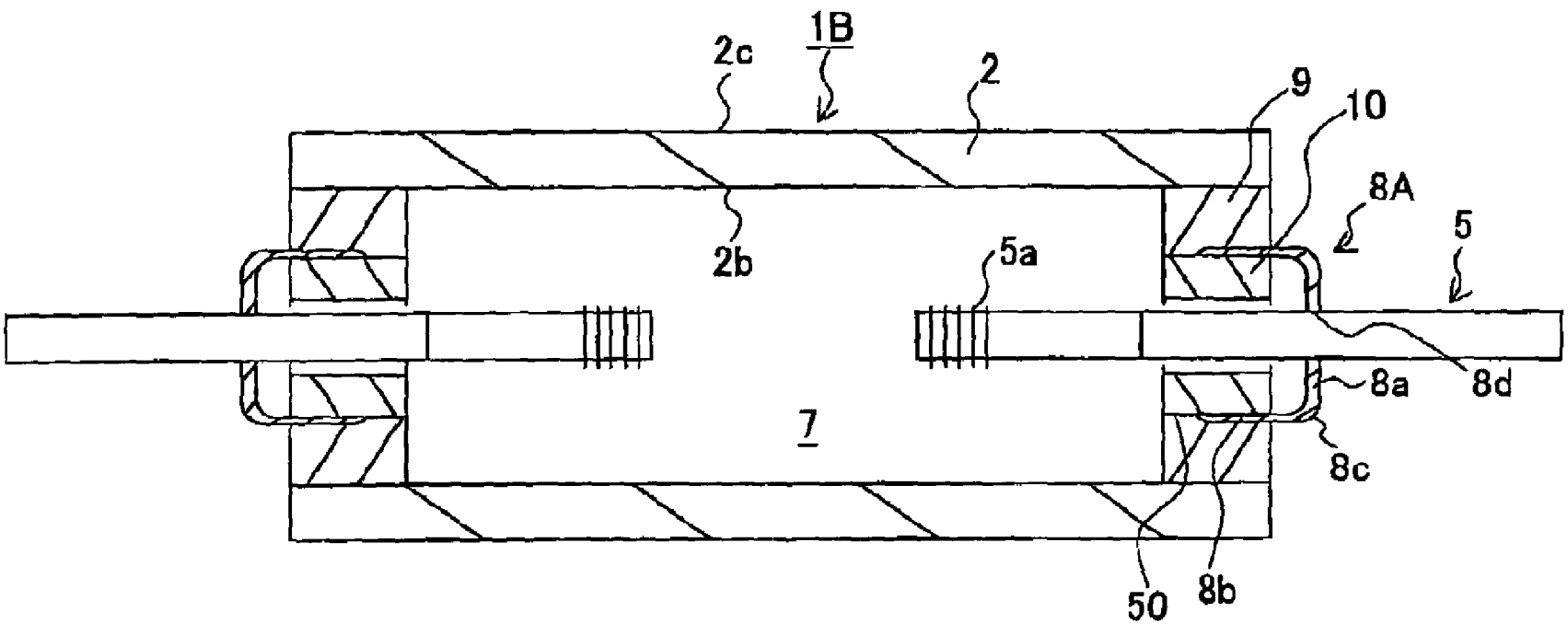
FIG. 4 is a cross sectional view schematically showing an assembly 1B for a cylindrical type luminous container 1B.

According to the tip end of a luminous container 1B in FIG. 4, on the side of inner surface 2*b* of the tip end 2*a* (not shown) of a cylindrical luminous vessel 2 made of brittle material, it is provided a cylindrical outer supporting body 9 having an outer shape of the analogous shape as that of the vessel and made of the same brittle material. An cylindrical inner supporting body 10 is provided inside of the outer supporting body 9. A seamless and cap-like clamped portion 8*b* of the plate-shaped metal piece 8A is clamped and fixed between the outer supporting body 9 and inner supporting body 10.

The non-clamped portions 8*a* and 8*c* of the electrode supporting member 8 made of the plate-shaped metal piece is protruded from the brittle material and the clamped portion 8*b* is embedded in the brittle material. Both sides of the clamped portion 8*b* is pressed toward the radial direction by the brittle material so as to deform the clamped portion 8*b* and thus to absorb and relax the stress due to the difference of physical property of the brittle material and metal. Further, the outer supporting body 9 and inner supporting body 10 directly contact each other at an interface 50 direct under the clamped portion.

In the case of FIG. 4, the diameter of winding part 5*a* of a coil made of tungsten or the like at the tip end of the electrode is made larger than the inner diameter of the inner supporting body 10, so that it may be impossible to insert the electrode rod from the outside of the luminous container into the inner space. In this case, the electrode and current through conductor are inserted in the inner space in advance in the assembling stage of the electrode supporting member and inner supporting body. The inner and outer supporting bodies are integrated utilizing the sintering shrinkage of the inner and outer supporting bodies, and the outer supporting body and luminous vessel are integrated utilizing the difference of the sintering shrinkage.

A hole 8*d* for inserting the current through conductor 5 is formed in the cover portion 8*a* of the electrode supporting member 8A. The hole, another hole in the inner supporting body and a clearance with the current through conductor are utilized to supply luminous substances or gas to be sealed into the luminous container, and current through conductor is then connected with the electrode supporting member to seal the luminous container by means of welding, soldering or the like in air-tight manner to obtain a luminous container 1B.

By applying the structure as shown in FIG. 4, it can be used a cap-like electrode supporting member 8A having a diameter smaller than the inner diameter of the luminous vessel 2 by the thickness of the outer supporting body 9. Since the inner pressure of the luminous vessel 2 is higher than atmospheric pressure, the diameter of the electrode supporting member 8A may preferably be made smaller so that the stress generated in the electrode supporting member 8A can be advantageously reduced. It is further possible to considerably reduce the contact area of the electrode supporting member 8A and corrosive luminous substance in the inner space 7 to effectively reduce the corrosion of the electrode supporting member 8A.

Figure 5:
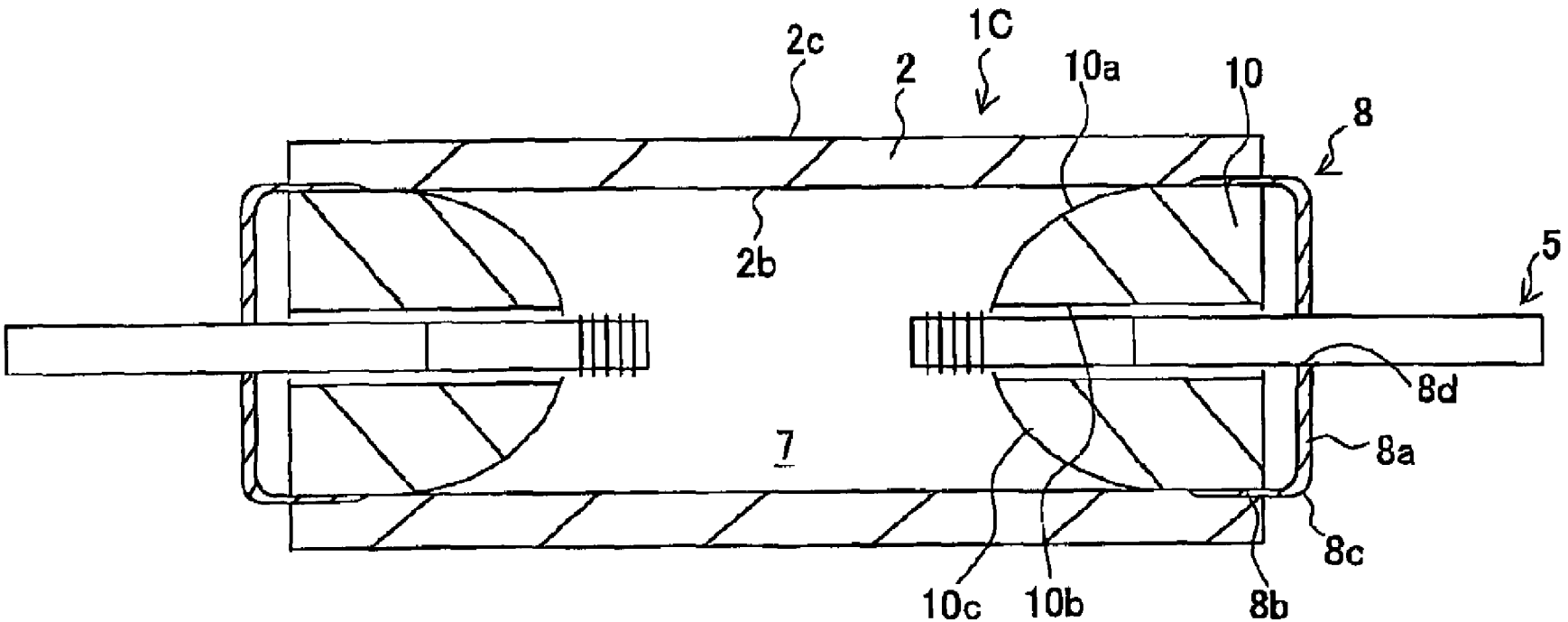
FIG. 5 is a cross sectional view schematically showing a cylindrical type luminous container 1C.

In the drawings following FIG. 5, parts having the same functions as those shown in FIGS. 2 and 4 are specified by the same numerals and the description may be omitted. According to a luminous container 1C of FIG. 5, a cylindrical luminous vessel 2 made of brittle material functions as the outer supporting body, and the clamped portion 8*b* of the electrode supporting member 8 is clamped between the inner surface 2*b* of the luminous vessel 2 and the inner supporting body 10 made of brittle material.

According to the present example, a protrusion 10 *c* is formed in the inner supporting body 10 toward the center of the inner space 7. The inner surface 10*b* of the protrusion 10*c* substantially has the same diameter and functions as a guide for protecting the electrode conducting portion 5. The outer surface 10*a* of the protrusion 10 is shaped to form a curved and inclined face along with the angle of radiation of light to avoid the interference of radiation from the luminous portion. Such protrusion prevents the deformation and corrosion of the electrode conductor 5 due to the luminous substance during light luminescence. It is further possible to reduce the volume not utilized for the light luminescence in the luminous vessel to reduce the amount of luminous substance sealed in the luminous vessel.

Figure 6:
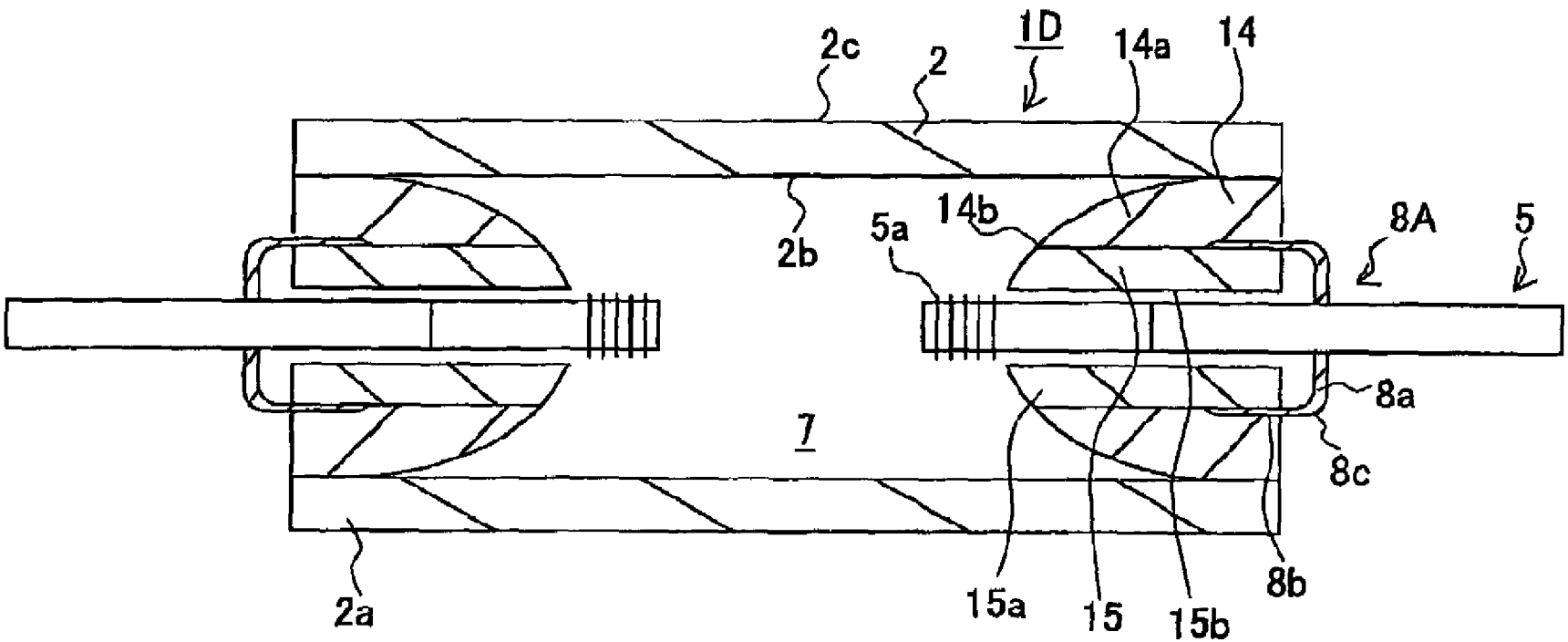
FIG. 6 is a cross sectional view schematically showing a cylindrical type luminous container 1D.

At the end of a luminous vessel 1D shown in FIG. 6, inside of an outer supporting body 14 made of brittle material, it is provided a cylindrical inner supporting body 15 having the analogous shape and made of the same material as the outer supporting body. The clamped portion 8*b* of an electrode supporting member 8A composed of a plate-shaped metal piece is clamped and fixed between the outer supporting body 14 and inner supporting body 15. The end of the cylindrical luminous vessel 2 of brittle material is provided outside of the outer supporting body 14 to form a luminous vessel 1D.

According to the present example, protrusions 14*a* and 15*a* are formed in supporting bodies 14, 15 toward the center of the inner space, respectively. The inner surface 15*b* of the protrusion 15*a* substantially has the same diameter and functions as a guide for protecting the electrode conducting portion 5. The outer surface 14*a* of the protrusion 14 is shaped to form a curved and inclined face along the angle of radiation of light to avoid the prevention of radiation from the luminous portion. Such protrusions 14*a* and 15*a* are provided for preventing the deformation and corrosion of the electrode conducting portion and electrode due to the luminous substance during light luminescence. It is further possible to reduce the volume not utilized for the light luminescence in the luminous vessel to reduce the amount of luminous substance sealed in the luminous vessel.

Figure 7:
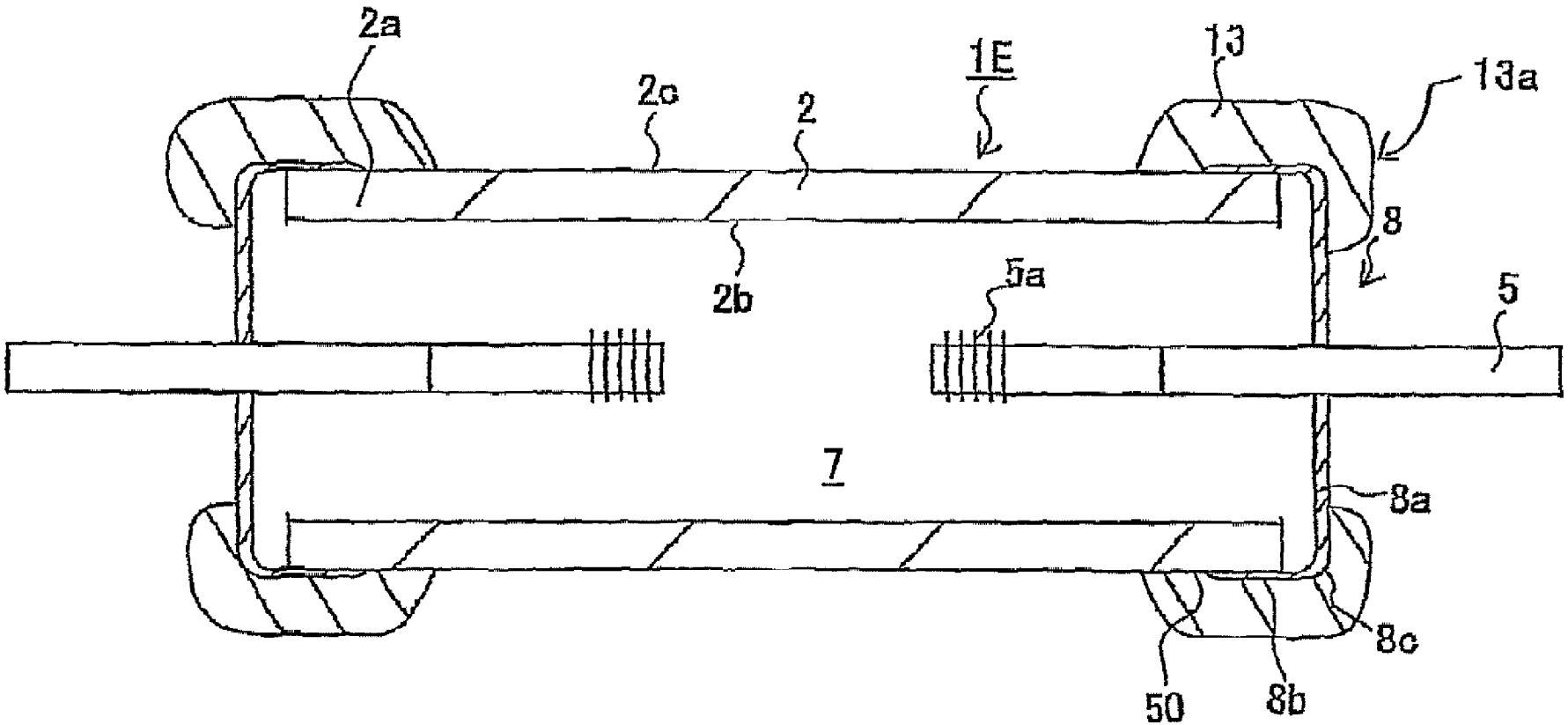
FIG. 7 is a cross sectional view schematically showing a cylindrical type luminous container 1E.

At the end of a luminous vessel 1E shown in FIG. 7, a cylindrical luminous vessel 2 made of brittle material functions as the inner supporting body, and an outer supporting body 13 made of brittle material has the analogous shape of a cylinder. The clamped portion 8*b* having the analogous shape as the luminous vessel 2 and outer supporting body 13 is clamped and fixed between the luminous vessel 2 and outer supporting body 13. Non-clamped portions 8*a* and 8*c* are protruded from the brittle material and the clamped portion 8*b* is embedded in the brittle material. The clamped portion 8*b* is pressed radially of the luminous vessel 2 with the brittle material to deform the clamped portion 8*b* to absorb and relax the stress due to the difference of physical property of the brittle material and metal. Further, the luminous vessel 2 and outer supporting body 13 directly contact each other along an interface 50 direct under the clamped portion 8*b*.

A pushing portion 13*a* is provided at the outer end of the outer supporting body 13 for supporting a cover 8*a* of an electrode supporting member 8, so that the deformation of 8*a* due to the inner pressure in the luminous vessel can be prevented.

As in the present example, when the luminous vessel 2 is used as the inner supporting body, the sintering shrinkage of the luminous vessel 2 is made smaller than that of the outer supporting body 13, or the luminous vessel 2 is made of a material not susceptible for sintering shrinkage, as described above.

Figure 8:
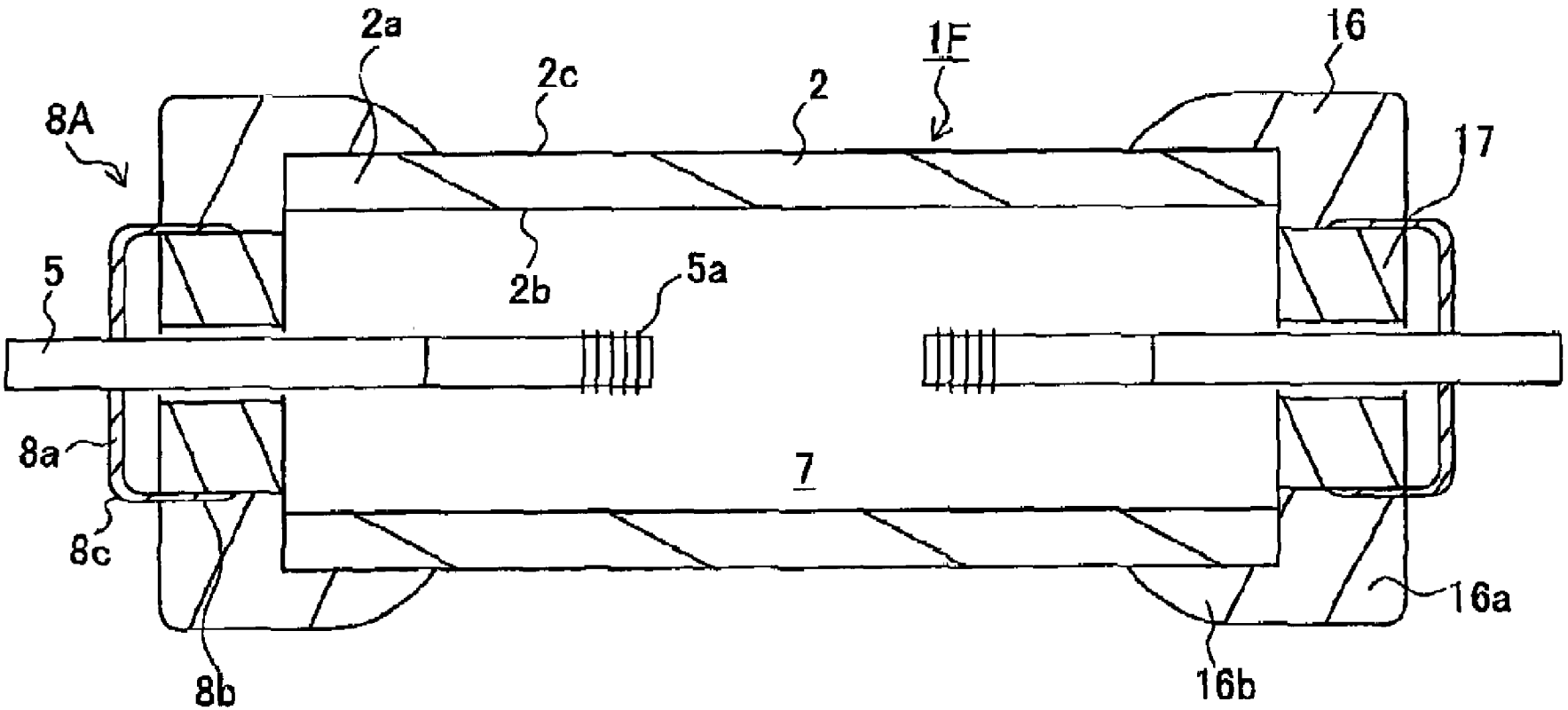
FIG. 8 is a cross sectional view schematically showing a cylindrical type luminous container 1F.

At the end of a luminous vessel 1F shown in FIG. 8, inside of a cylindrical outer supporting body 16 made of brittle material, it is provided a cylindrical inner supporting body 17 having the analogous shape as the outer supporting body and made of brittle material. The cylindrical clamped portion 8*b* having the analogous shape as the outer supporting body 16 and inner supporting body 17 is clamped and fixed between the outer supporting body 16 and inner supporting body 17.

The outer supporting body 16 further clamp the outer surface 2*c* of the end portion 2*a* of the cylindrical luminous vessel 2 made of brittle material from the outside to form the luminous container 1F.

As in the present example, when the luminous vessel 2 is pressed and clamped with the outer supporting body 16, the sintering shrinkage of the luminous vessel 2 is made smaller than that of the outer supporting body 16, or the luminous vessel 2 is made of a material not susceptible for sintering shrinkage, as described above.

As in the present example, when the outer supporting body 16 clamps the clamped portion 8*b* and the luminous vessel 2 from the outside, the contact area of the electrode supporting member 8 with luminous substance in the inner space can be considerably reduced to further improve the reliability of the end portion.

Figure 9:
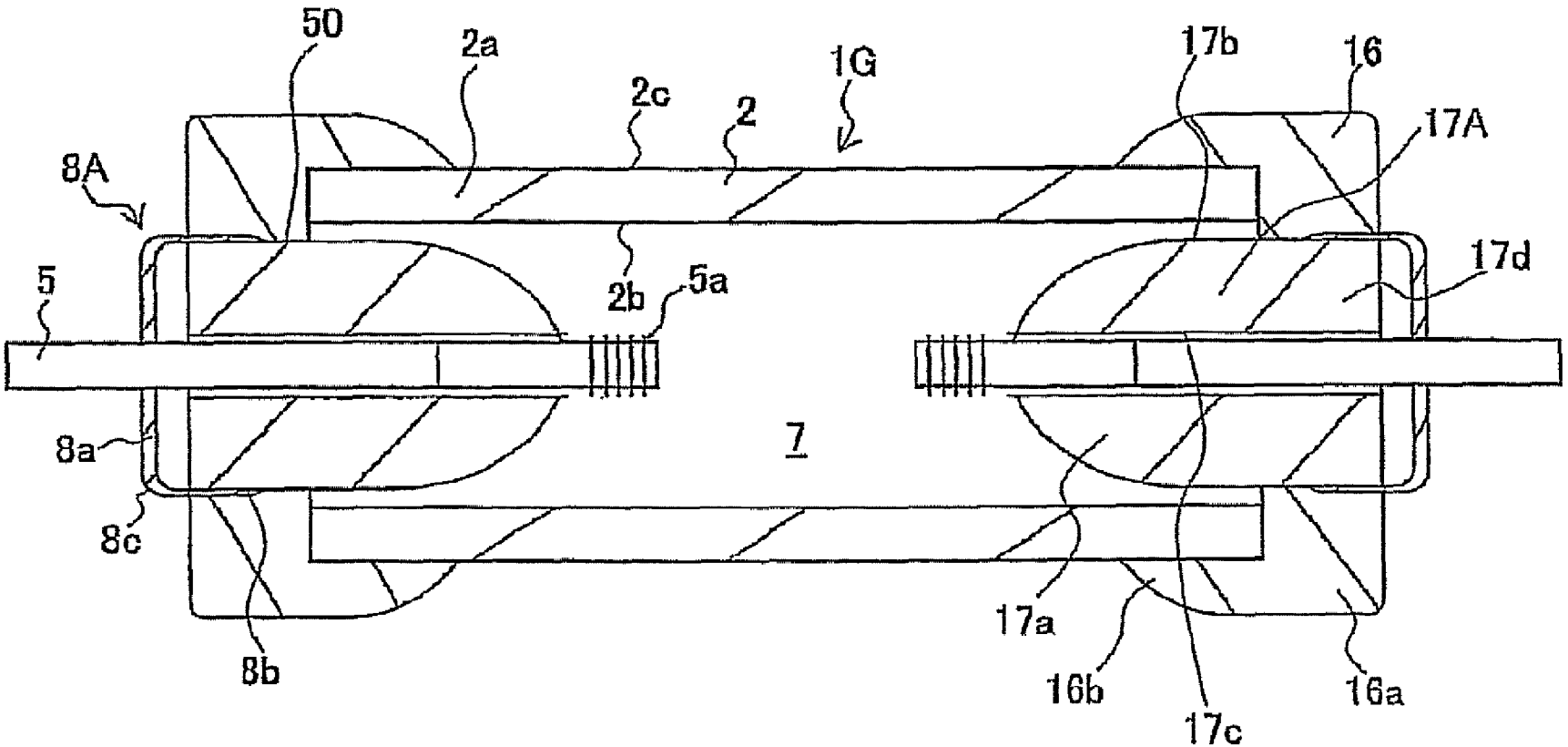
FIG. 9 is a cross sectional view schematically showing a cylindrical type luminous container 1G.

According to a luminous container 1G shown in FIG. 9, inside of a cylindrical outer supporting body 16 made of brittle material, it is provided a cylindrical base 17*d* of an inner supporting body 17A made of brittle material and having the analogous shape as the outer supporting body. The clamped portion 8*b* having a cylindrical portion with the analogous shape as the outer and inner supporting bodies between the outer supporting body 16 and inner supporting body 17A. The cylindrical luminous container 2 made of brittle material is provided inside of the outer supporting body 16 to form a luminous vessel.

According to the present example, a protrusion 17*a* is formed in the inner supporting body 17A toward the center of the inner space 7. The inner surface 17*c* of the protrusion 17*a* substantially has the same diameter as the current through conductor 5 and electrode 5*a*, and functions as a guide for protecting the electrode conducting portion 5 and electrode 5*a*. The outer surface 17*b* of the protrusion 17*a* is shaped to form a curved and inclined face along the angle of radiation of light to avoid the interference of irradiation from the luminous vessel. Such protrusion prevents the deformation and corrosion of the electrode conducting portion 5 and electrode 5*a* due to the luminous substance during light luminescence. It is further possible to reduce the volume not utilized for the light luminescence in the luminous vessel to reduce the amount of luminous substance sealed in the luminous vessel.

Figure 10:
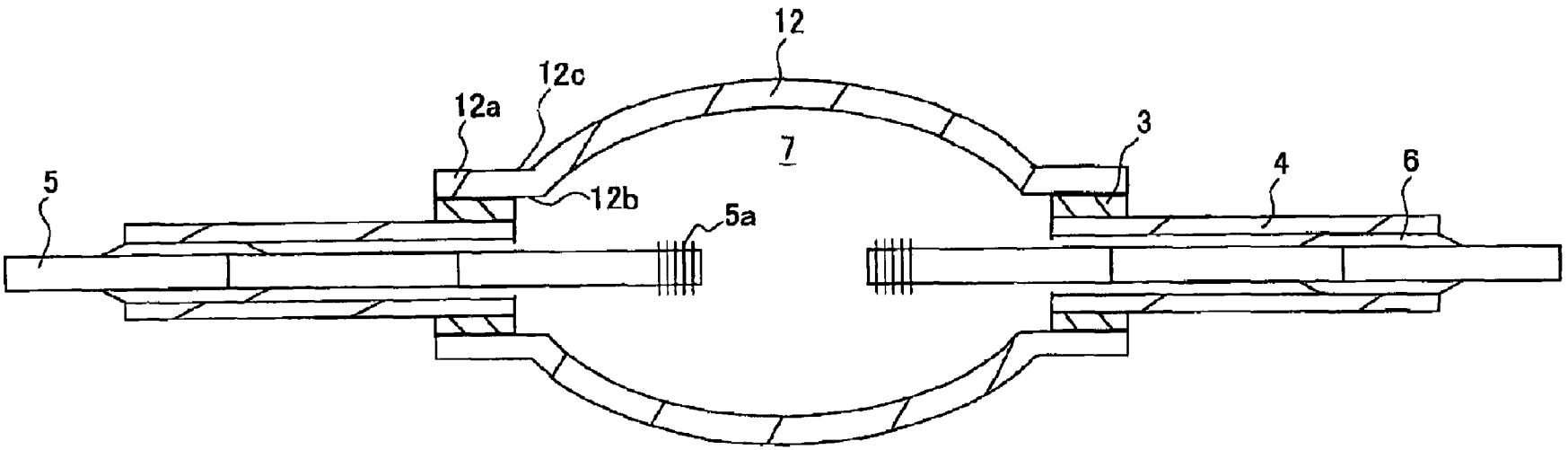
FIG. 10 is a cross sectional view schematically showing an elliptical type luminous container of a prior art.

FIG. 10 shows a luminous container of a prior art.

FIGS. 11 to 15 show luminous containers each using so called luminous vessel 2 of elliptical type (one body type).

An alumina supporting tube 4 is fixed on the inner surface 12*b* of each of the ends 12*a* of a luminous vessel 12 having a shape of a straight tube through a sealing member 3 made of alumina. The supporting tube 4 and current through conductor 5 are sealed with a sealing material 6. According to this structure, luminous substance at high temperature filled in the inner space 7 of the luminous vessel 12 contacts the sealing material 6, so that the corrosion of the sealing material 6 tends to occur to result in a structural problem.

Further, although niobium may preferably be applied as the material of the current through conductor 5 having a thermal expansion coefficient near that of a ceramic (alumina), niobium is susceptible to a luminous substance and thus problematic. Therefore, the current through conductor and electrode may be made of three kinds of materials such as niobium-molybdenum-tungsten or niobium-cermet (a composite sintered body of molybdenum and alumina)-tungsten, the sealing of the electrode may be made at the niobium portion and further the niobium portion may be sealed with a frit material so that the frit material covers a part of accurately controlled portion of molybdenum or cermet for protecting the niobium portion. It is thus possible to relax the thermal stress and prevent the corrosion of niobium.

The electrode rod consisting of three kinds of materials creates high production costs and the need for accurate control of the sealing position of the frit material, so that increased production time is required.

Figure 11:
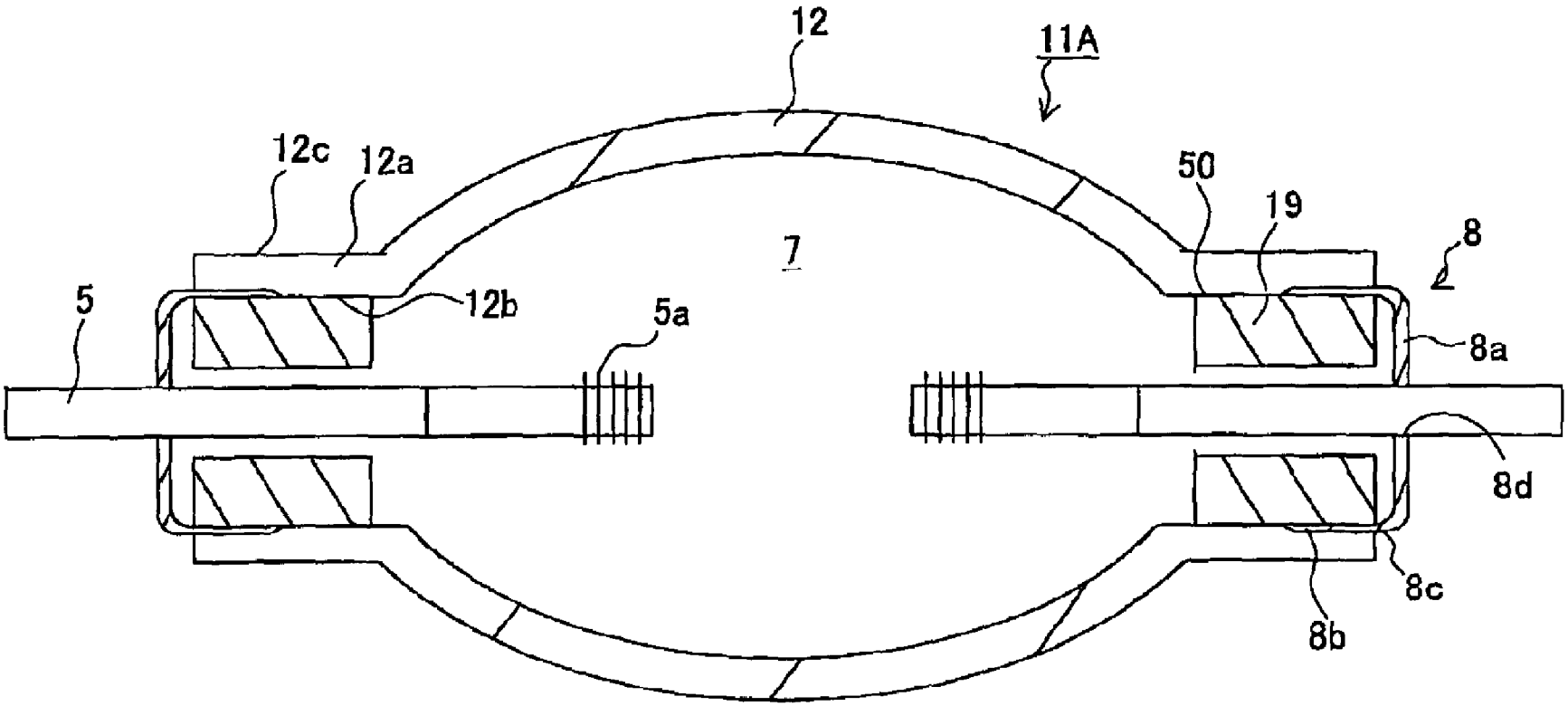
FIG. 11 is a cross sectional view schematically showing a luminous container 11A of elliptical type (one-body type).

According to a luminous container 11A shown in FIG. 11, a cylindrical luminous vessel 12 made of a brittle material functions as an outer supporting body at the end 12*a* of the luminous vessel, and an inner supporting body 19 made of a brittle material has a shape of a cylinder having the analogous shape as the outer supporting body. A clamped portion 8*b* of the plate-shaped metal piece 8 is clamped and fixed between the luminous container 12 and inner supporting body 19. The plate-shaped metal piece 8 functions as a supporting member for the electrode 5*a*. Non-clamped portions 8*a* and 8*c* are protruded from the brittle material, and the clamped portion 8*b* is embedded in the brittle material. Both faces of the clamped portion 8*b* is pressed to deform the clamped portion 8*b* and to relax the stress due to the difference of physical properties of the brittle material and metal. Further, the luminous vessel 12 and inner supporting body 19 directly contact each other direct under the clamped portion 8*b* along surface 12*b*.

8*a* has a shape of a disk and functions as a cover or a cap. A curved part 8*c* is formed between the cover 8*a* and clamped portion 8*b*. A hole 8*d* is formed in the cover 8*a* for passing the electrode 5*a* and current through conductor 5. The hole is utilized to supply luminous substance or gas to be sealed into the luminous container, the electrode and current through conductor are then inserted and connected with the cap-like metal piece to assemble the luminous vessel by means of welding, soldering or the like.

Figure 12:
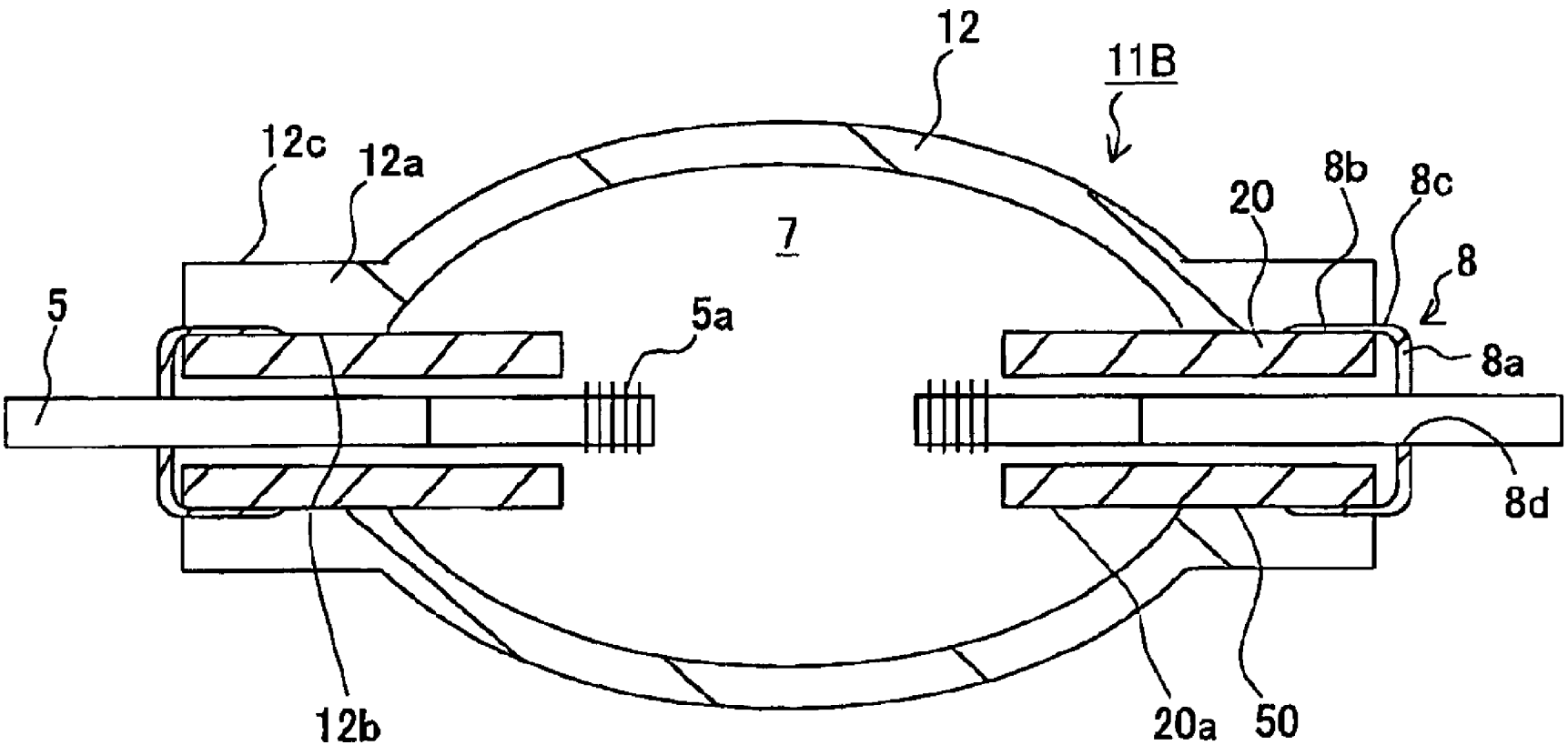
FIG. 12 is a cross sectional view schematically showing a luminous container 11B of elliptical type.

According to a luminous container 11B shown in FIG. 12, the clamped portion 8*b* of the electrode supporting member 8 is clamped between the inner surface 12*b* of the end portion 12*a* of the luminous vessel 12 and the cylindrical inner supporting body 20, as described above. According to the present example, it forms a cylindrical protrusion 20*a* having a constant diameter protruding from the inner supporting body 20 toward the center of the inner space 7. The protrusion 20*a* functions as a guide for protecting the current through conductor 5 and electrode 5*a*.

Figure 13:
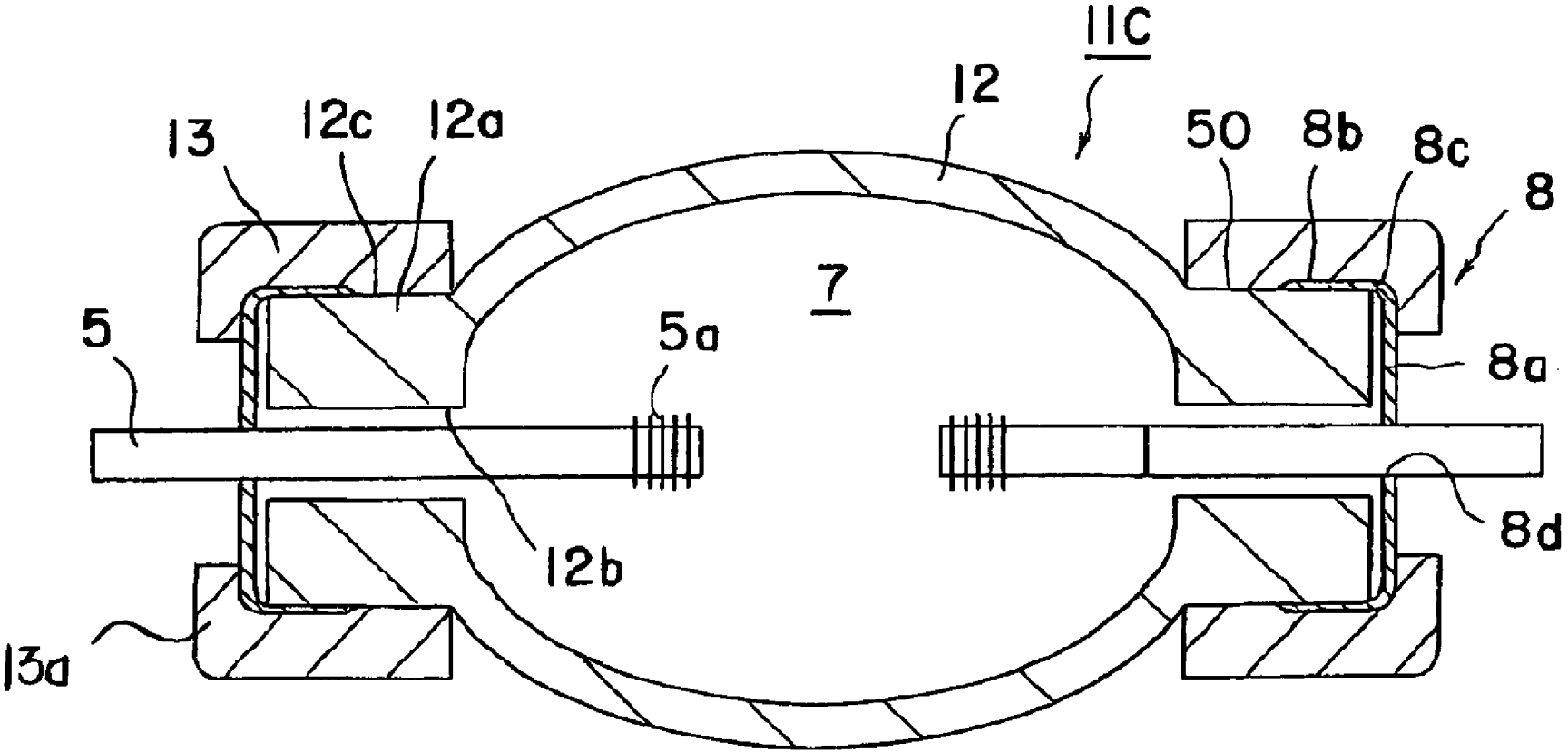
FIG. 13 is a cross sectional view schematically showing a luminous container 11C of elliptical type.

According to the tip end of a luminous vessel 11C shown in FIG. 13, the luminous vessel 12 made of brittle material functions as the inner supporting body, and the outer supporting body 13 made of brittle material has the analogous shape as the inner supporting body. The clamped portion 8*b* having the analogous shape as the luminous vessel 12 and outer supporting body 13 is clamped and fixed between the luminous vessel 12 and outer supporting body 13. The non-clamped portions 8*a* and 8*c* are protruded from the brittle material and the clamped portion 8*b* is embedded in the brittle material. The clamped portion 8*b* is pressed toward the radial direction in the luminous vessel 12 by the brittle material so as to deform the clamped portion 8*b* and thus to absorb and relax the stress due to the difference of physical property of the brittle material and metal. Further, the outer supporting body 13 and luminous vessel 12 directly contact each other direct under the clamped portion 12*c*. A pushing portion 13*a* is provided at the outer tip end of the outer supporting body 13 for supporting the cover 8*a* of the electrode supporting member 8 from the outside to prevent the deformation of 8*a* by the inner pressure of the luminous vessel.

Figure 14:
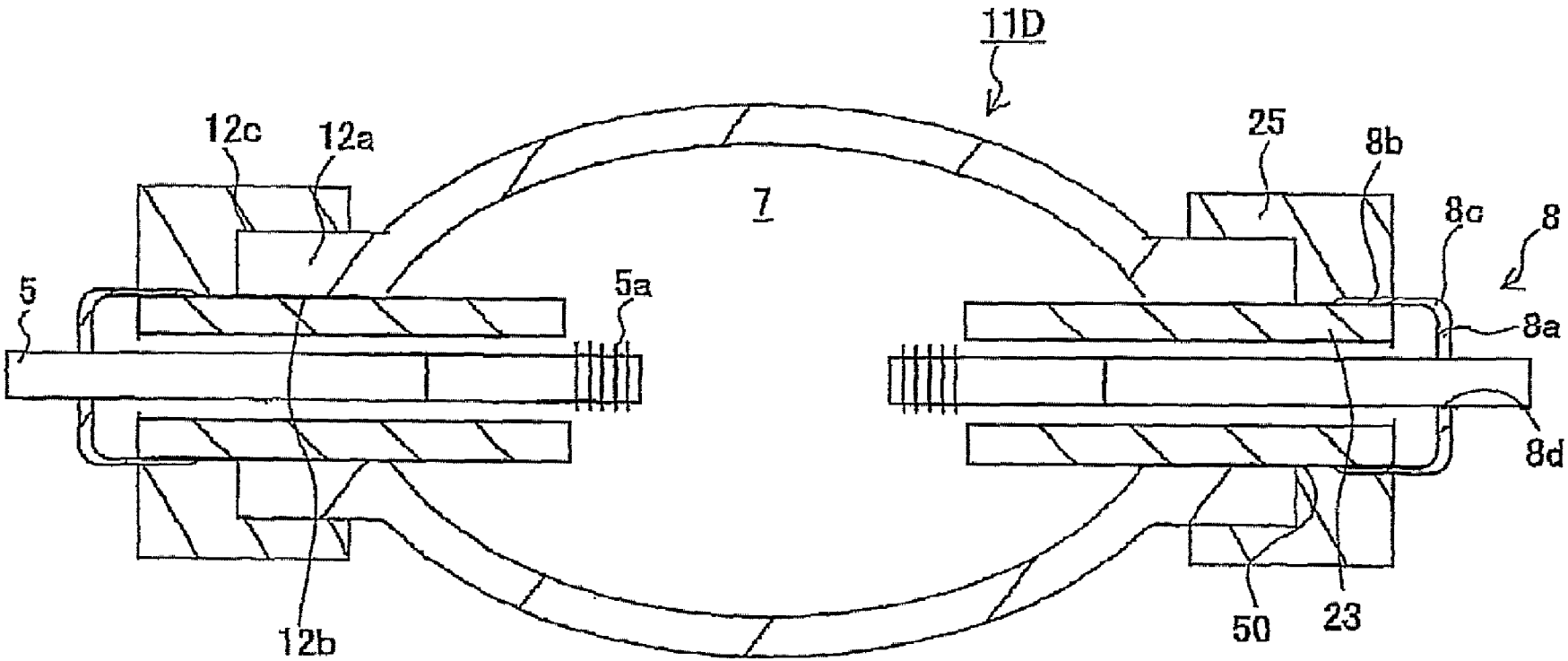
FIG. 14 is a cross sectional view schematically showing a luminous container 11D of elliptical type.

According to the tip end of a luminous vessel 11D shown in FIG. 14, inside of a cylindrical outer supporting body 25 made of brittle material, it is provided a cylindrical inner supporting body 23 made of brittle material and having the analogous shape and the same diameter as the outer supporting body. The cylindrical clamped portion 8*b* having the analogous shape as the outer supporting body 25 and inner supporting body 23 is clamped and fixed between the outer supporting body 25 and inner supporting body 23. The outer supporting body 25 clamps the outer surface 12*c* of the end portion 12*a* of the cylindrical luminous vessel 12 made of brittle material from the outside to form a luminous vessel 11D.

Figure 15:
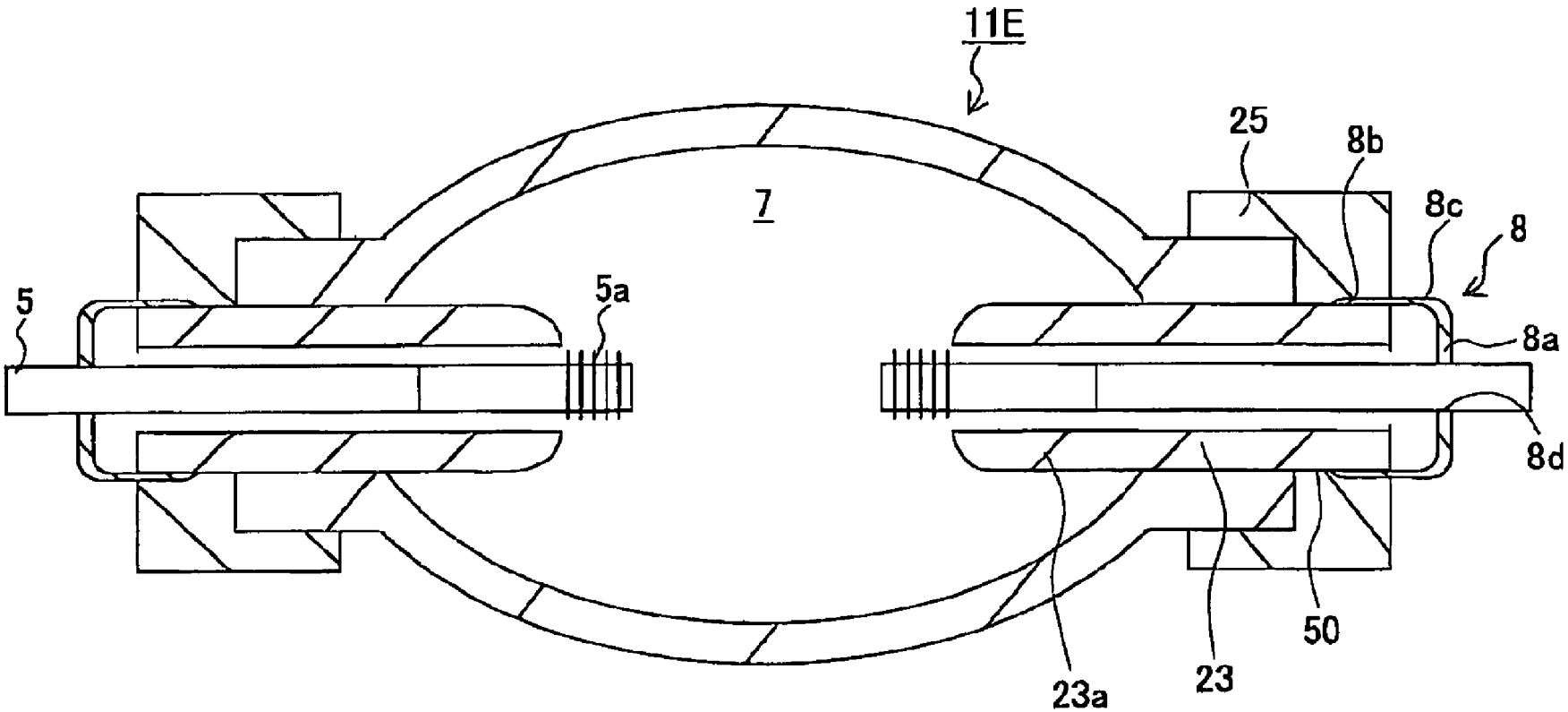
FIG. 15 is a cross sectional view schematically showing a luminous container 11E of elliptical type.

A luminous container 11E shown in FIG. 15 is substantially the same as the luminous container 11D of FIG. 14. According to FIG. 15, however, the inner supporting body 23 has a cylindrical protrusion 23*a* protruding toward the center of the inner space 7. The protrusion 23*a* functions as a guide for protecting the current through conductor 5 and electrode 5*a*.

Figure 16:
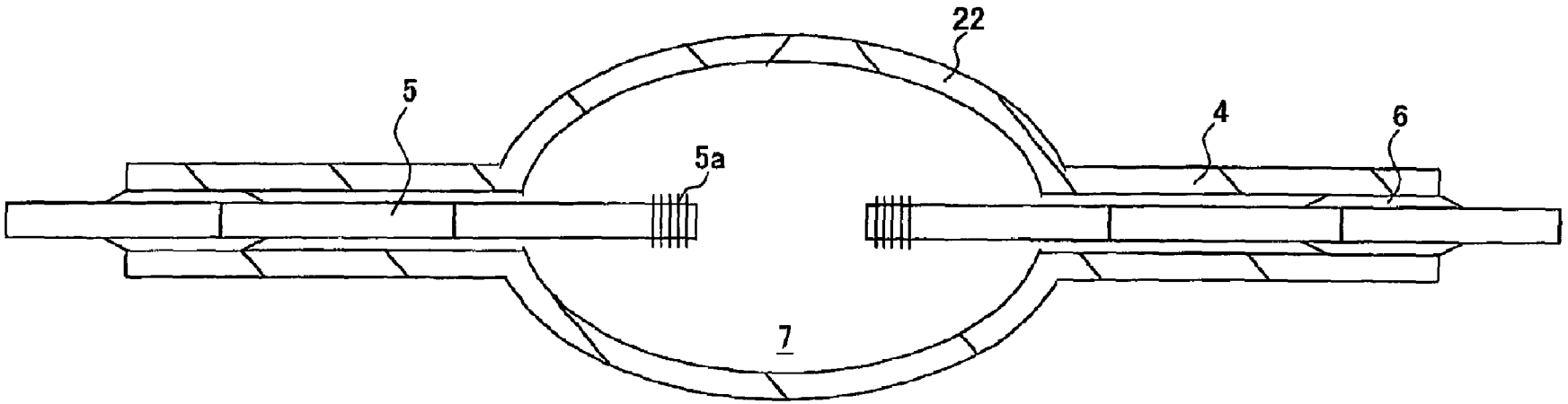
FIG. 16 is a cross sectional view schematically showing an elliptical type luminous container of a prior art.

FIG. 16 shows a luminous container of a prior art.

FIGS. 17 to 21 show luminous vessels each using so called luminous vessel 2 of elliptical type (two bodies type).

A tube-like luminous vessel 22 has a shape of a barrel. The current through conductor 5 is sealed with a sealing material 6 at both ends of the luminous vessel 22. Further, although niobium may preferably be applied as the material of the current through conductor 5 having a thermal expansion coefficient near that of a ceramic (alumina), niobium is susceptible to a luminous substance and thus problematic. Therefore, the current through conductor and electrode may be made of three kinds of materials such as niobium-molybdenum-tungsten or niobium-cermet (a composite sintered body of molybdenum and alumina)-tungsten, the sealing of the electrode may be made at the niobium portion and further the niobium portion may be sealed with a frit material so that the frit material covers a part of accurately controlled portion of molybdenum or cermet for protecting the niobium portion. It is thus possible to relax the thermal stress and prevent the corrosion of niobium.

The electrode rod consisting of three kinds of materials creates high production costs and the need for accurate control of the sealing position of the frit material, so that increased production time is required.

Figure 17:
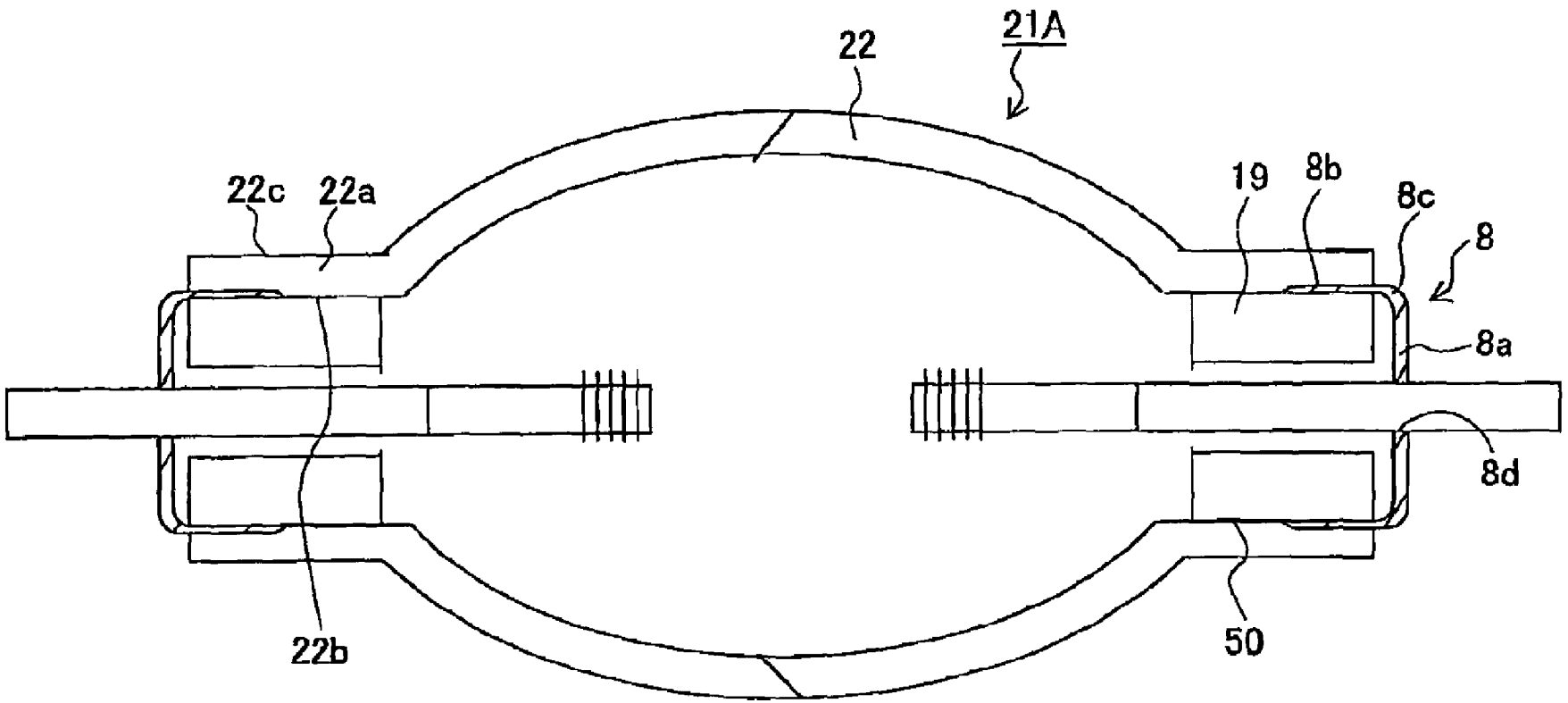
FIG. 17 is a cross sectional view schematically showing a luminous container 21A of elliptical type (two-body type).

According to a luminous container 21A shown in FIG. 17, a cylindrical luminous vessel 22 made of a brittle material functions as an outer supporting body at the end 22*a* of the luminous vessel, and an inner supporting body 19 made of a brittle material has a shape of a cylinder of the analogous shape as the outer supporting body. A clamped portion 8*b* of the plate-shaped metal piece is clamped and fixed between the luminous container 22 and inner supporting body 19. The plate-shaped metal piece 8 functions as a supporting member for the current through conductor 5 and electrode 5*a*. Non-clamped portions 8*a* and 8*c* are protruded from the brittle material, and the clamped portion 8*b* is embedded in the brittle material. Both faces of the clamped portion 8*b* is pressed to deform the clamped portion 8*b* and to relax the stress due to the difference of physical properties of the brittle material and metal. Further, the luminous vessel 22 and inner supporting body 19 directly contact each other direct under the clamped portion 8*b* along surface 22*b*.

8*a* has a shape of a disk and functions as a cover or a cap. A curved part 8*c* is formed between the cover 8*a* and clamped portion 8*b*. A hole 8*d* is formed in the cover 8*a* for passing the electrode 5*a* and current through conductor 5. The hole 8*d* is utilized to supply luminous substances or gas to be sealed into the luminous container, the electrode and current through conductor are then inserted and connected with the cap-like metal piece to assemble the luminous vessel by means of welding, soldering or the like.

If molybdenum material having excellent corrosion resistance is used for the cap-like metal piece and current through conductor, the current through conductor and electrode can be formed of two kinds of materials of molybdenum and tungsten. Therefore the requirement to make the current through conductor and electrode of three kinds of materials of niobium-molybdenum-tungsten or niobium-cermet (composite sintered body of molybdenum and alumina)-tungsten is removed. Further the accurate control of the sealed positions with frit material is unnecessary.

Figure 18:
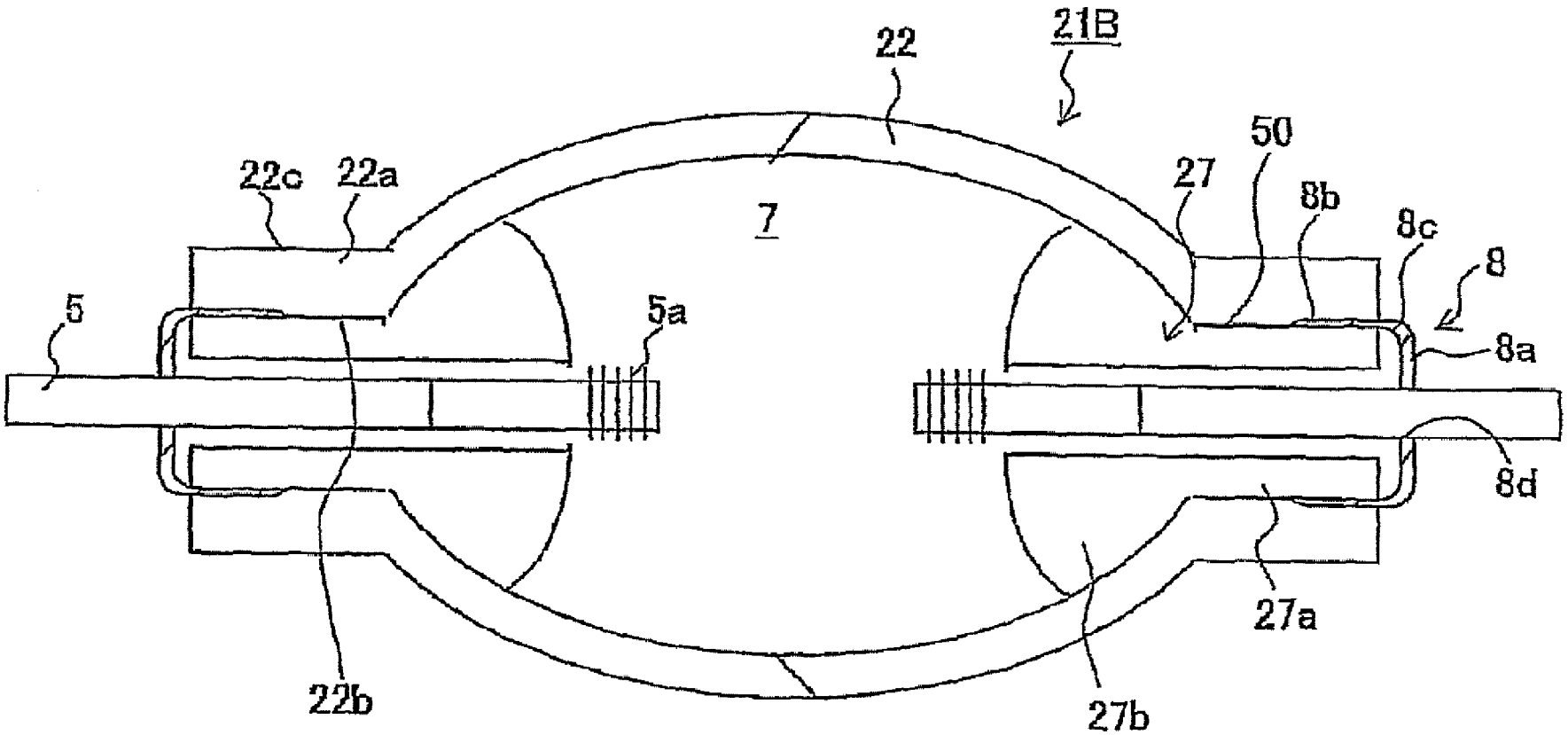
FIG. 18 is a cross sectional view schematically showing a luminous container 21B of elliptical type.

According to a luminous container 21B shown in FIG. 18, the clamped portion 8*b* of the electrode supporting member 8 is clamped between the inner surface 22*b* of the end portion 22*a* of the luminous vessel 22 and the cylindrical part 27*a* of the inner supporting body 27, as described above. According to the present example, it is formed a protrusion 27*b* protruding in the inner supporting body 27 toward the center of the inner space 7. The protrusion 27*b* functions as a guide for protecting the current through conductor 5.

Figure 19:
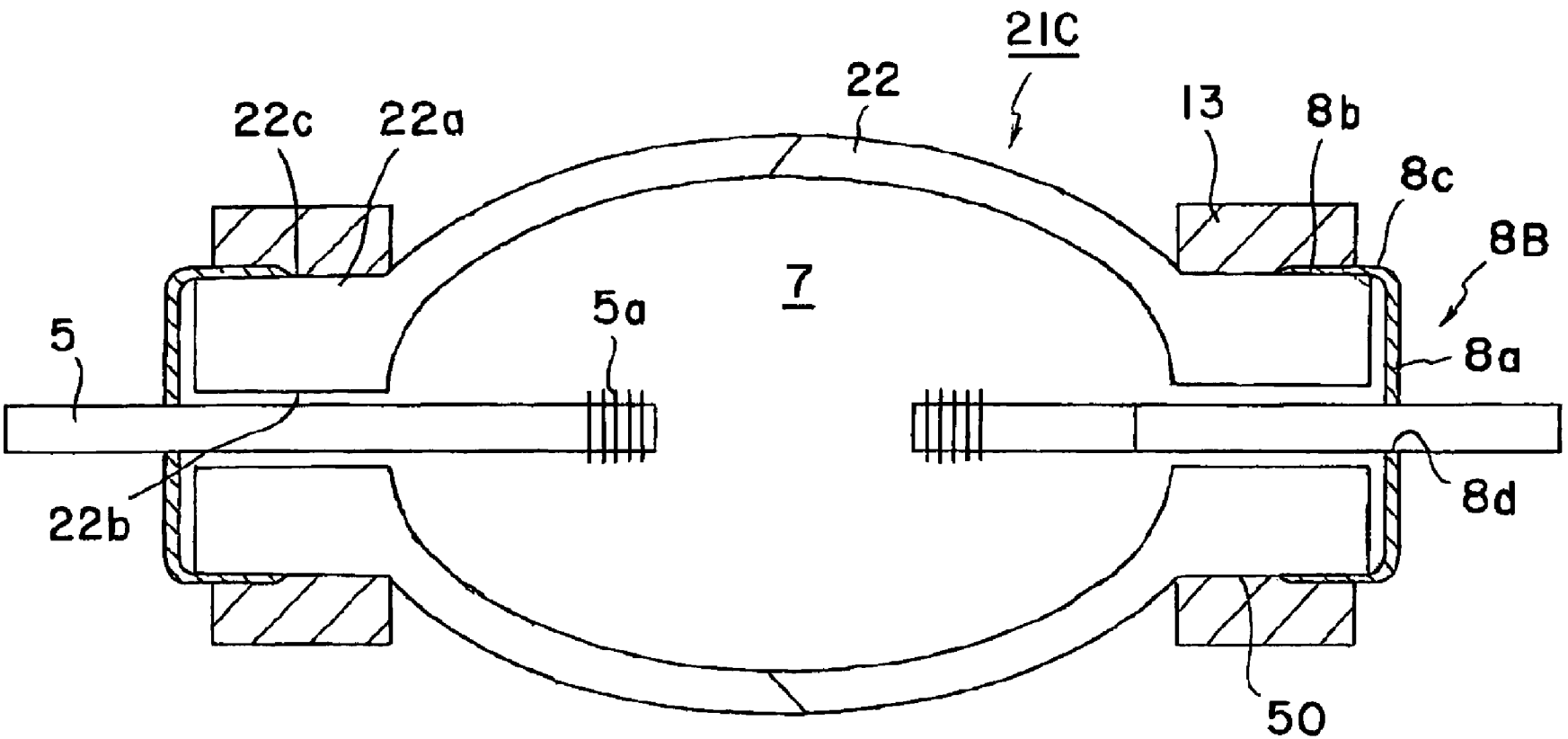
FIG. 19 is a cross sectional view schematically showing a luminous container 21C of elliptical type.

At the tip end of a luminous vessel 21C shown in FIG. 19, the luminous vessel 22 made of brittle material functions as the inner supporting body, and the cylindrical outer supporting body 13 made of brittle material has the analogous shape as the inner supporting body. The clamped portion 8*b* having the analogous shape as the luminous vessel 22 and outer supporting body 13 is clamped and fixed between the luminous vessel 22 and outer supporting body 13. The non-clamped portions 8*a* and 8*c* are protruded from the brittle material and the clamped portion 8*b* is embedded in the brittle material. The clamped portion 8*b* is pressed toward the radial direction in the luminous vessel by the brittle material so as to deform the clamped portion 8*b* and thus to absorb and relax the stress due to the difference of physical property of the brittle material and metal. Further, the luminous vessel 22 and outer supporting body 13 directly contact each other direct under the clamped portion 8*b* along surface 50.

Figure 20:
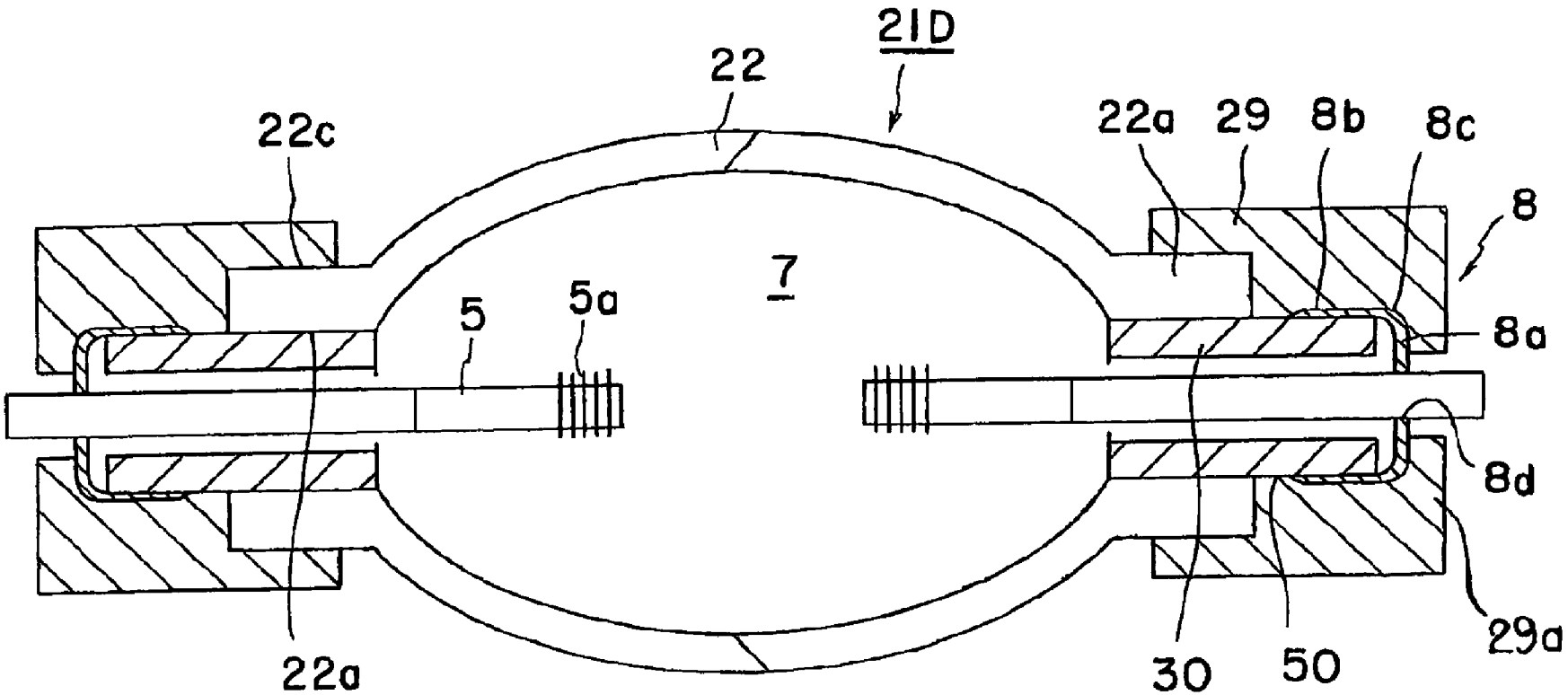
FIG. 20 is a cross sectional view schematically showing a luminous container 21D of elliptical type.

At the tip end of a luminous vessel 21D shown in FIG. 20, inside of a cylindrical outer supporting body 29 made of brittle material, it is provided a cylindrical inner supporting body 30 made of brittle material and having the analogous shape and the same diameter as the outer supporting body. The cylindrical clamped portion 8*b* is clamped and fixed between the outer supporting body 29 and inner supporting body 30. The outer supporting body 29 clamps the outer surface 22*c* of the end portion 22*a* of the cylindrical luminous vessel 22 made of brittle material from the outside to form a luminous vessel 21D. A pushing portion 29*a* is provided at the outer end portion of the outer supporting body 29 for supporting the cover 8*a* of the electrode supporting portion from the outside, so that the deformation of 8*a* due to the inner pressure can be prevented.

Figure 21:
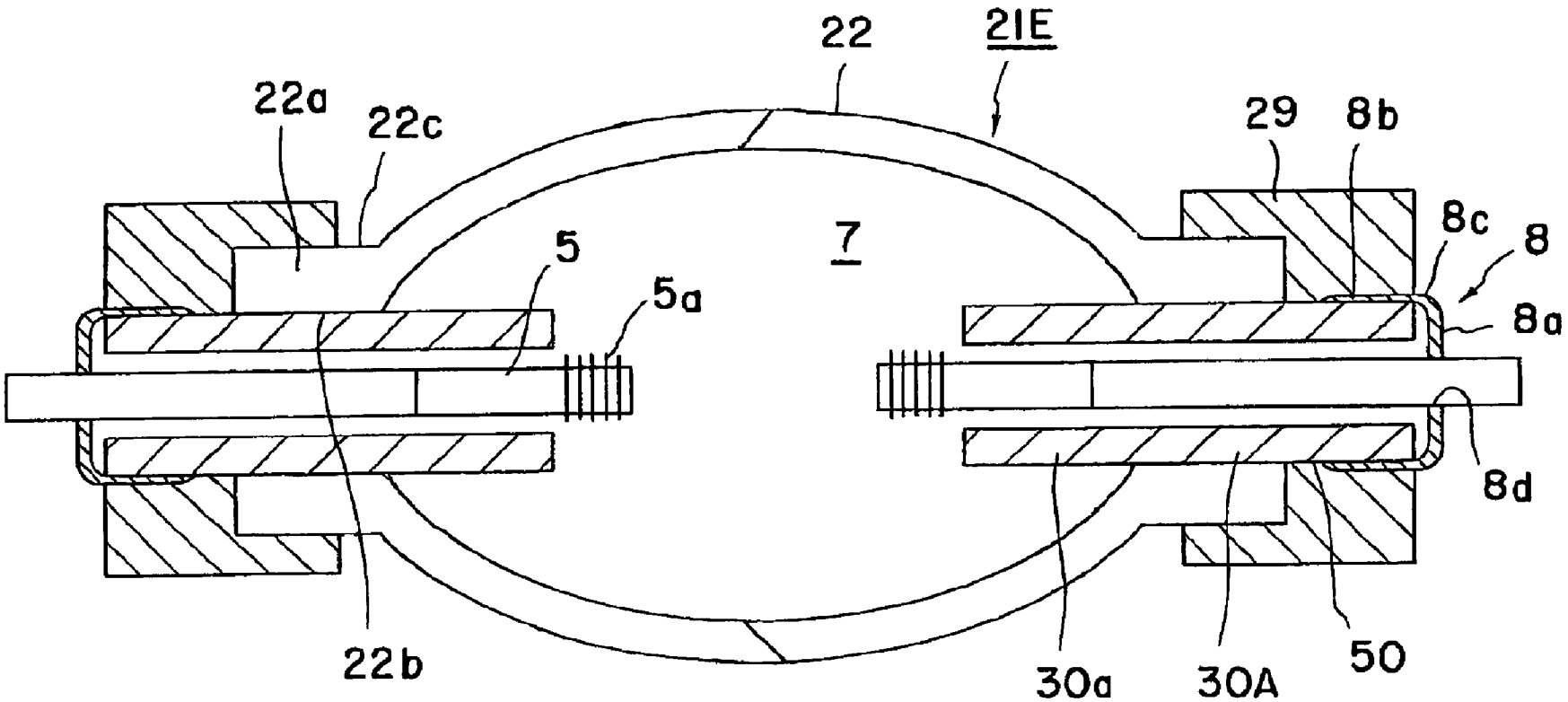
FIG. 21 is a cross sectional view schematically showing a luminous container 21E of elliptical type.

A luminous container 21E shown in FIG. 21 is substantially the same as the luminous container 21D of FIG. 20. According to FIG. 21, however, the inner supporting body 30A has a cylindrical protrusion 30*a* protruding toward the center of the inner space 7. The protrusion 30*a* functions as a guide for protecting the current through conductor 5 and electrode 5*a*.

Figure 22:
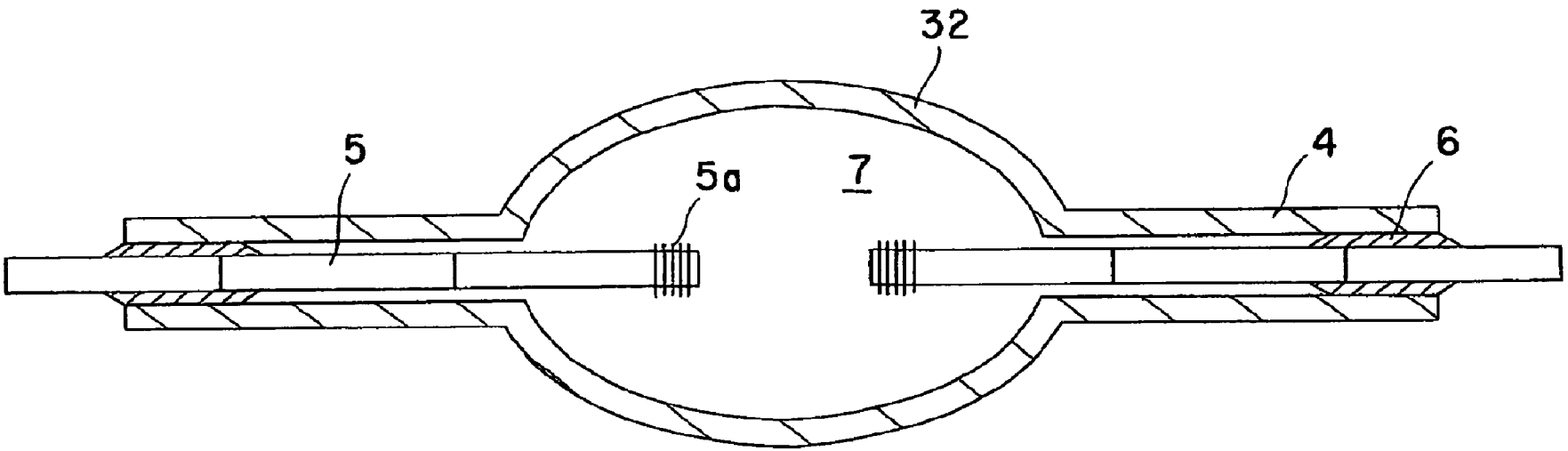
FIG. 22 is a cross sectional view schematically showing an elliptical type luminous container 32 of a prior art.

FIG. 22 shows a luminous vessel of a prior art.

FIGS. 23 to 29 show luminous vessels each using so called luminous vessel 32 of elliptical type (one body type).

A tube-like luminous vessel 32 has a shape of a barrel. The current through conductor 5 is sealed with a sealing material 6 at each end of the luminous vessel 32. Further, although niobium may preferably be applied as the material of the current through conductor 5 having a thermal expansion coefficient near that of a ceramic (alumina), niobium is susceptible to a luminous substance and thus problematic. Therefore, the current through conductor and electrode may be made of three kinds of materials such as niobium-molybdenum-tungsten or niobium-cermet (a composite sintered body of molybdenum and alumina)-tungsten, the sealing of the electrode may be made at the niobium portion and further the niobium portion may be sealed with a frit material so that the frit material covers a part of accurately controlled portion of molybdenum or cermet for protecting the niobium portion. It is thus possible to relax and the thermal stress and prevent the corrosion of niobium.

The electrode rod consisting of three kinds of materials creates high production costs and the need for accurate control of the sealing position of the frit material, so that increased production time is required.

Figure 23:
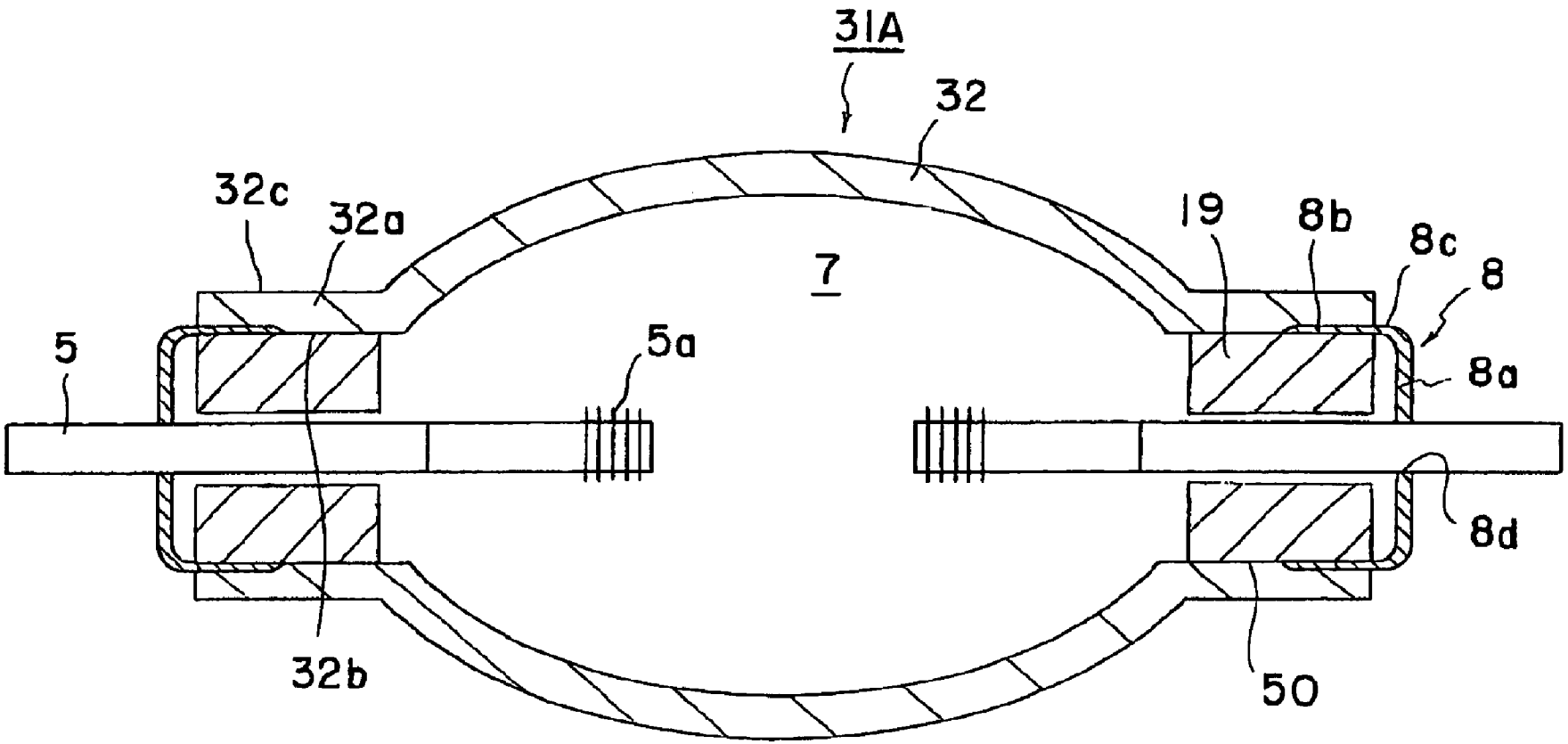
FIG. 23 is a cross sectional view schematically showing an assembly 31A for a luminous container of elliptical type (one-body type).

According to a luminous container 31A shown in FIG. 23, a cylindrical luminous vessel 32 made of a brittle material functions as an outer supporting body at the end 32*a* of the luminous vessel 32, and a cylindrical inner supporting body 19 made of a brittle material has the analogous shape as the outer supporting body. A clamped portion 8*b* of the plate-shaped metal piece 8 is clamped and fixed between the luminous container 32 and inner supporting body 19. The plate-shaped metal piece 8 functions as a supporting member for the current through conductor 5 and electrode 5*a*. Non-clamped portions 8*a* and 8*c* are protruded from the brittle material, and the clamped portion 8*b* is embedded in the brittle material. Both faces of the clamped portion 8*b* is pressed to deform the clamped portion 8*b* and to relax the stress due to the difference of physical properties of the brittle material and metal.

According to the present example, the diameter of winding part 5*a* of a coil made of tungsten or the like at the tip end of the electrode is larger than the inner diameter of the inner supporting body 19, so that the electrode and current through conductor are integrated with the luminous vessel while they are inserted into the hole of the inner supporting body 19 in advance. Since the electrode supporting body and current through conductor are not sealed in air-tight manner, luminous substance is supplied into the luminous vessel through a clearance of the electrode supporting member and current through conductor. They are then sealed in air-tight manner. It is thus possible to complete the assembly of the luminous container.

Figure 24:
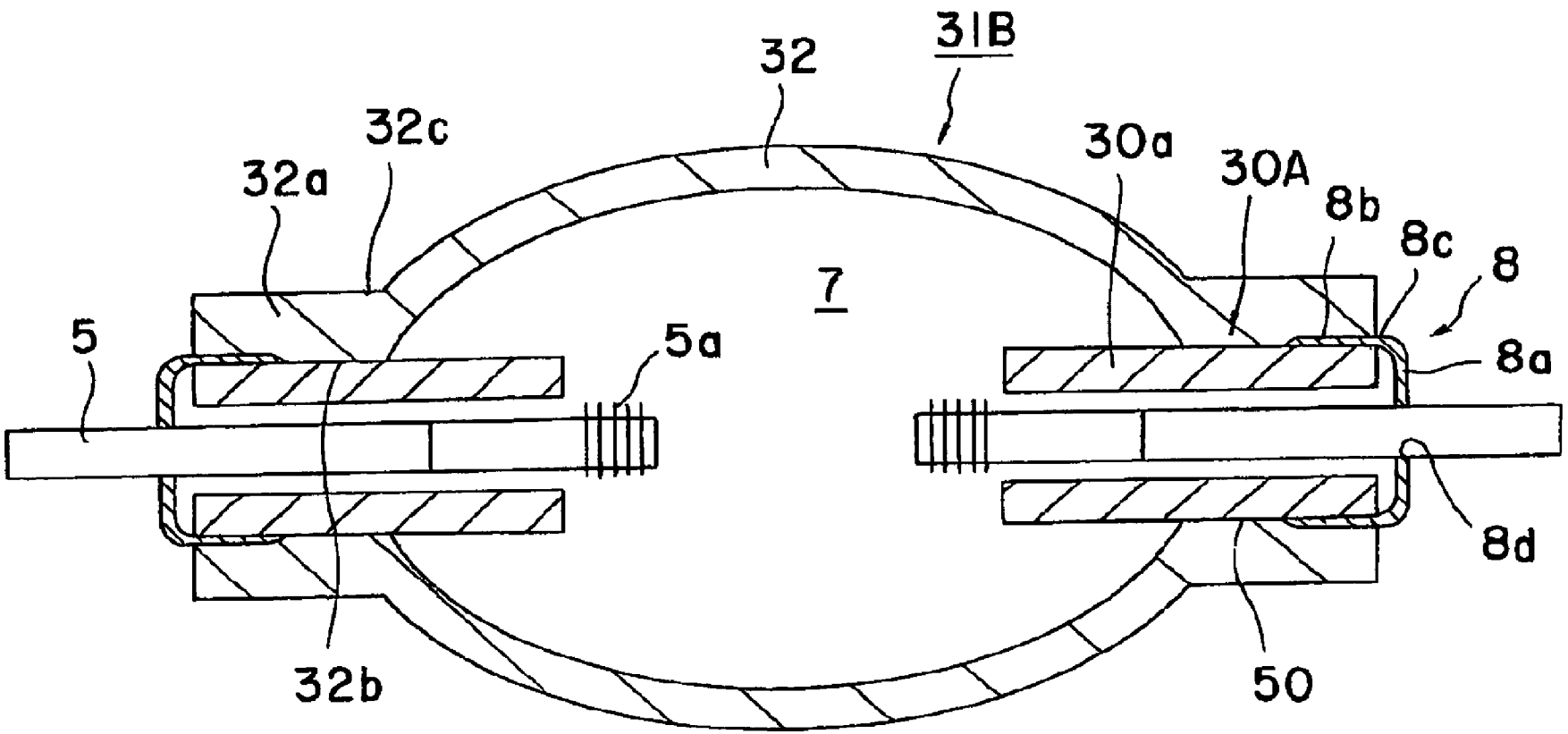
FIG. 24 is a cross sectional view schematically showing a luminous container 31B of elliptical type.

According to a luminous container 31B shown in FIG. 24, the clamped portion 8*b* of the electrode supporting member 8 is clamped between the inner surface 32*b* of the end portion 32*a* of the luminous vessel 32 and the inner supporting body 30A, as described above. According to the present example, it forms a protrusion 30*a* in the inner supporting body 30A toward the center of the inner space 7. The protrusion 30*a* functions as a guide for protecting the current through conductor 5 and electrode 5*a*.

Figure 25:
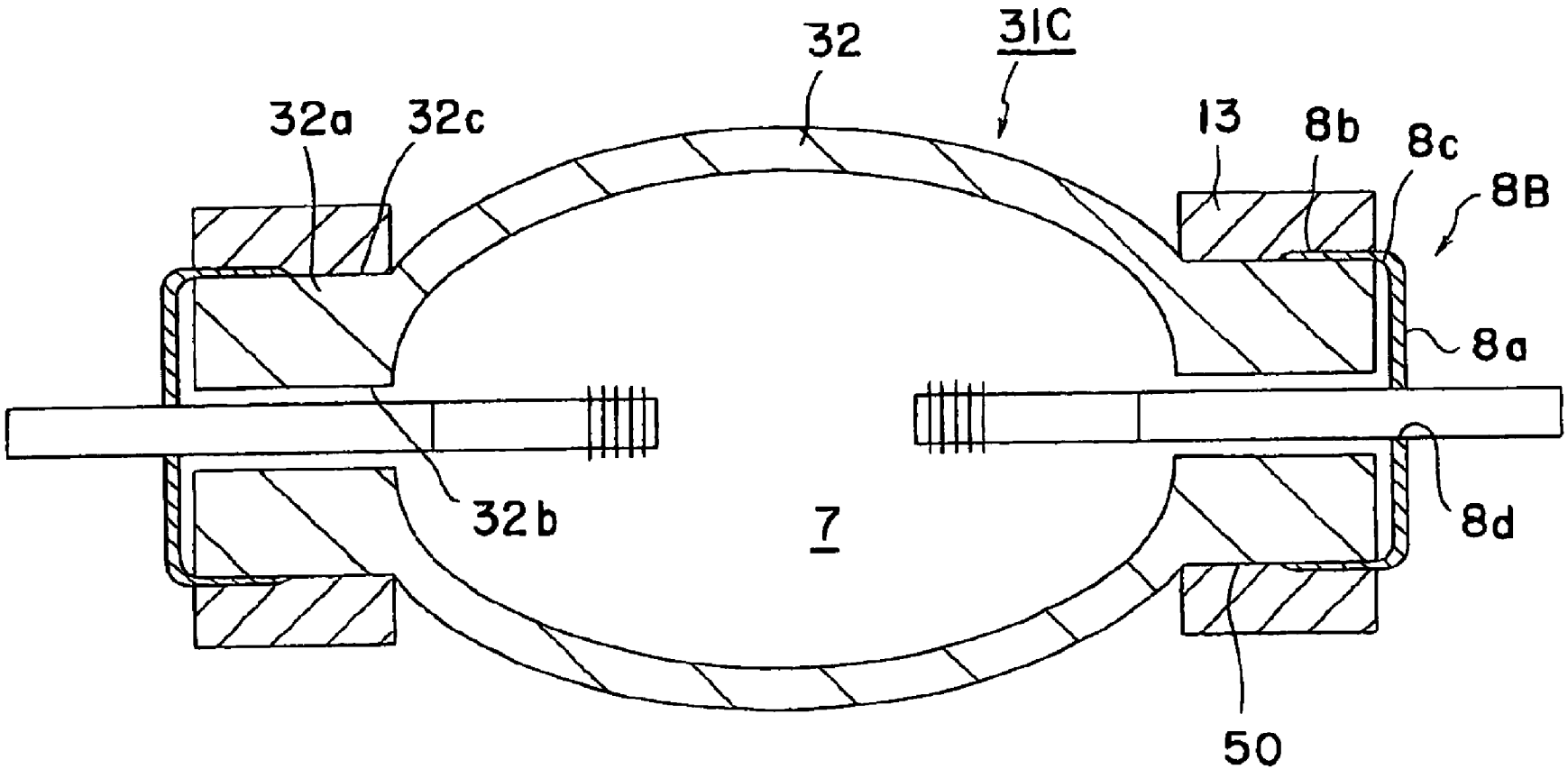
FIG. 25 is a cross sectional view schematically showing a luminous container 31C of elliptical type.

At the tip end of a luminous vessel 31C shown in FIG. 25, the luminous vessel 32 made of brittle material functions as the inner supporting body, and the cylindrical outer supporting body 13 made of brittle material has the analogous shape as the inner supporting body. The clamped portion 8*b* is clamped and fixed between the luminous vessel 32 and outer supporting body 13. The non-clamped portions 8*a* and 8*c* are protruded from the brittle material and the clamped portion 8*b* is embedded in the brittle material. The clamped portion 8*b* is pressed toward the radial direction by the brittle material so as to deform the clamped portion 8*b* and thus to absorb and relax the stress due to the difference of physical property of the brittle material and metal.

Figure 26:
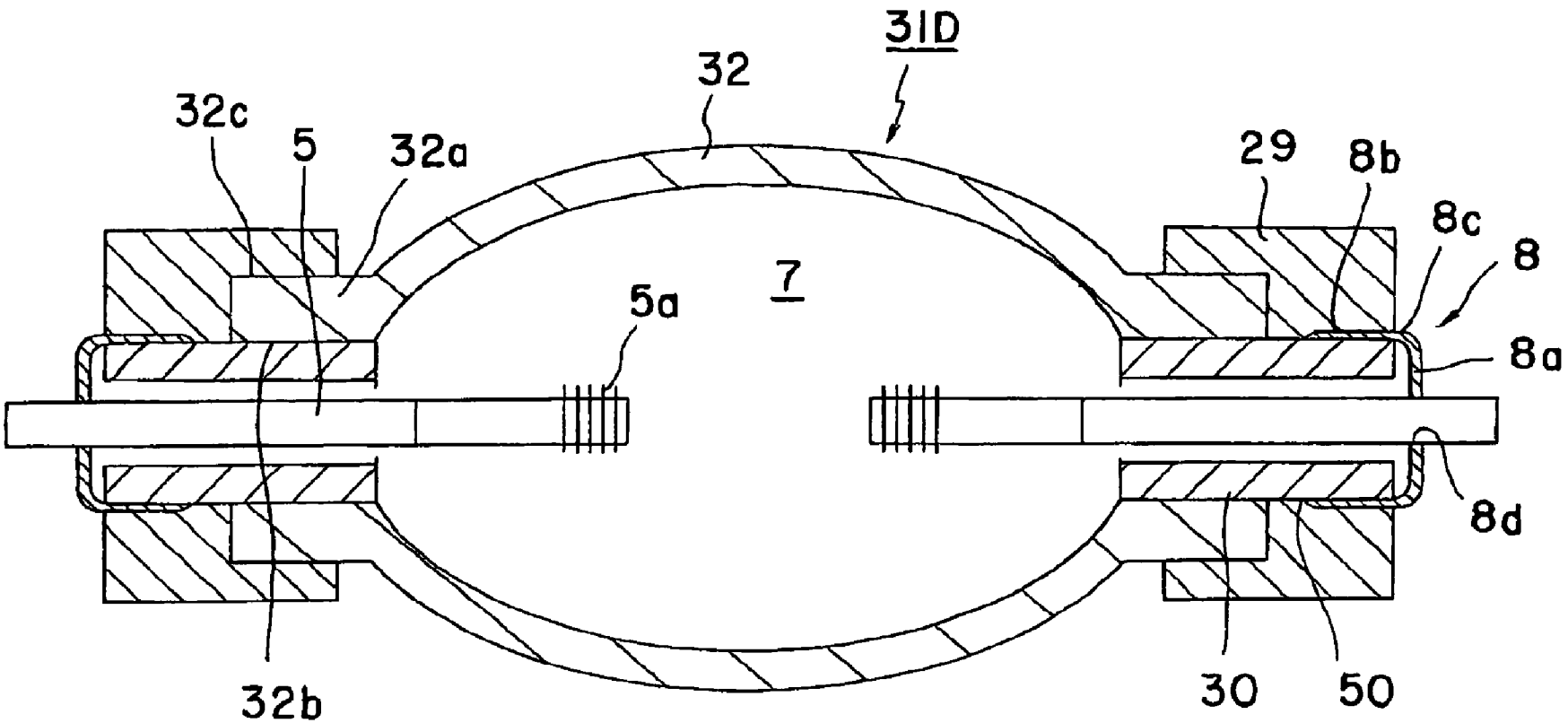
FIG. 26 is a cross sectional view schematically showing a luminous container 31D of elliptical type.

At the tip end of a luminous vessel 31D shown in FIG. 26, inside of a cylindrical outer supporting body 29 made of brittle material, it is provided a cylindrical inner supporting body 30 made of brittle material and having the analogous shape and the same diameter as the outer supporting body. The cylindrical clamped portion 8*b* having the analogous shape as the outer supporting body 29 and inner supporting body 30 is clamped and fixed between the outer supporting body 29 and inner supporting body 30. The outer supporting body 29 clamps the outer surface 32*c* of the end portion 32*a* of the cylindrical luminous vessel 32 made of brittle material from the outside to form a luminous vessel 31D.

Figure 27:
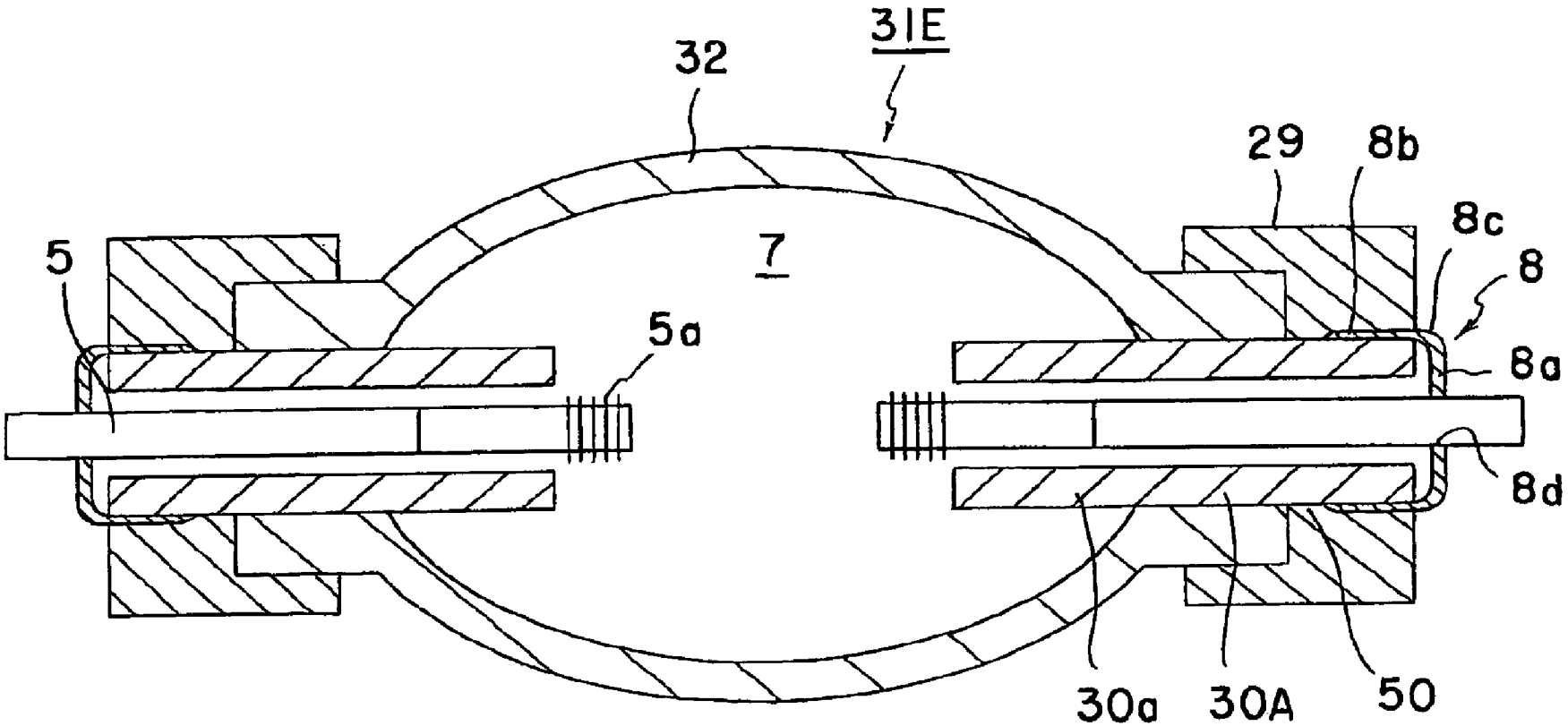
FIG. 27 is a cross sectional view schematically showing a luminous container 31E of elliptical type.

A luminous container 31E shown in FIG. 27 is substantially the same as the luminous container 31D of FIG. 26. According to FIG. 27, however, the inner supporting body 30A has a cylindrical protrusion 30*a* protruding toward the center of the inner space 7. The protrusion 30*a* functions as a guide for protecting the current through conductor 5 and electrode 5*a*.

Figure 28:
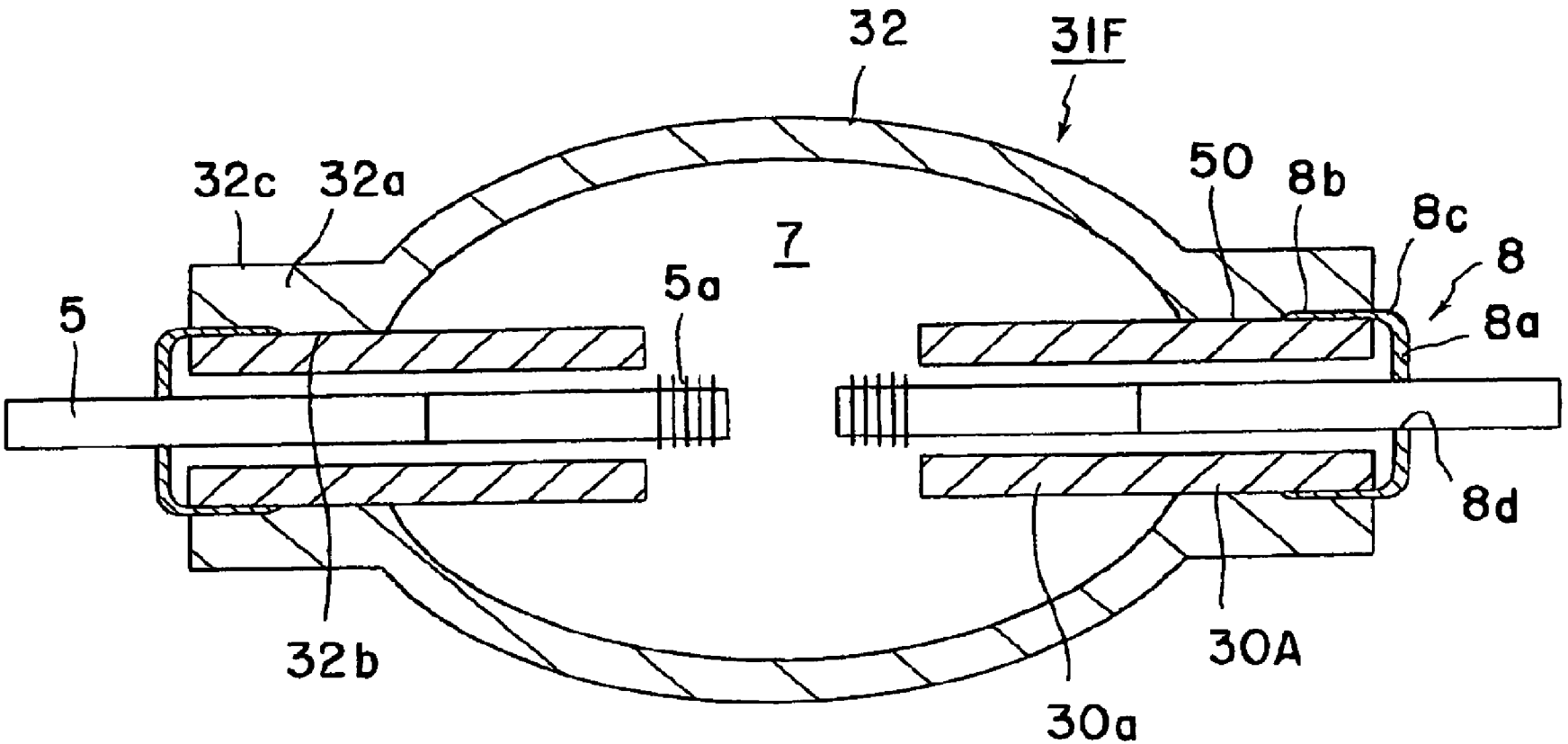
FIG. 28 is a cross sectional view schematically showing a luminous container 31F of elliptical type.

A luminous container 31F shown in FIG. 28 is substantially the same as the luminous container 31B of FIG. 24. According to FIG. 28, however, the distance of opposing electrodes is smaller and the inner supporting body 30A has a longer cylindrical protrusion 30*a* protruding toward the center of the inner space 7. The protrusion 30*a* functions as a guide for protecting the current through conductor 5 and electrode 5*a*.

Figure 29:
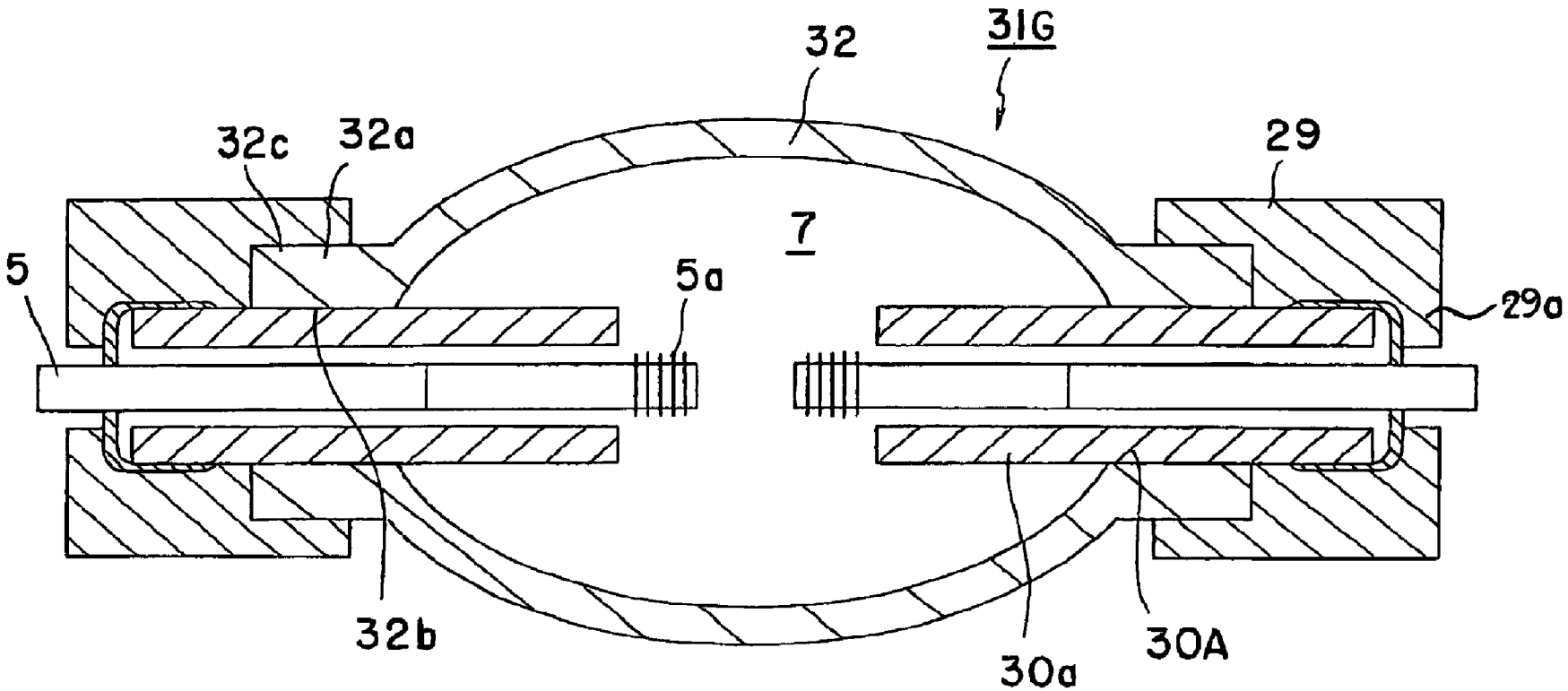
FIG. 29 is a cross sectional view schematically showing a luminous container 31G of elliptical type.

A luminous container 31G shown in FIG. 29 is substantially the same as the luminous container 31E of FIG. 27. According to FIG. 29, however, the inner supporting body 30A has a longer and cylindrical protrusion 30*a* protruding toward the center of the inner space 7. The protrusion 30*a* functions as a guide for protecting the current through conductor 5 and electrode 5*a*. A pushing portion 29*a* is provided at the outer end portion of the outer supporting body 29 for supporting the cover 8*a* of the electrode 8 from the outside to prevent the deformation of 8*a* due to the inner pressure of the luminous vessel.

Figure 30:
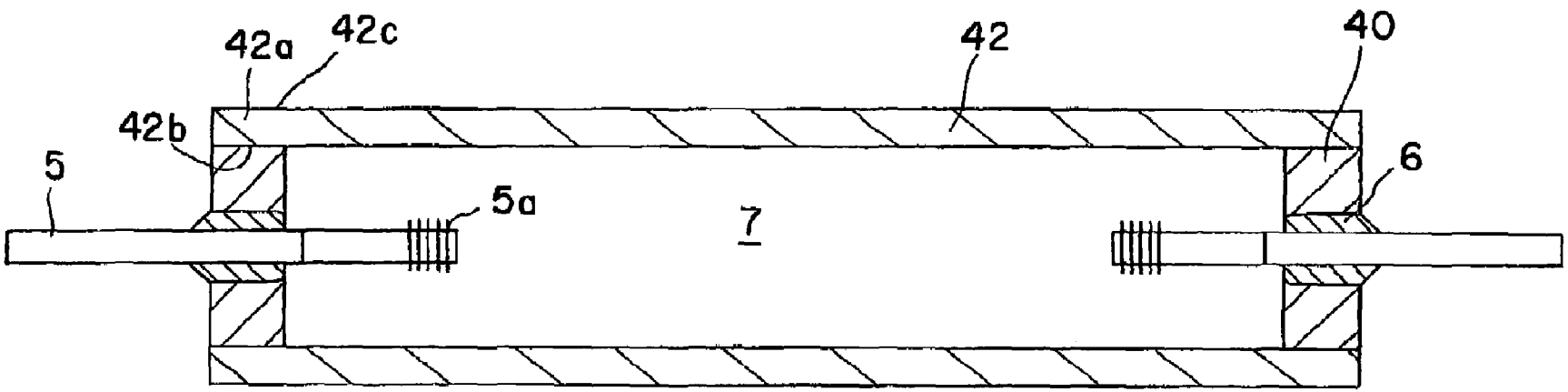
FIG. 30 is a cross sectional view schematically showing an HPS type luminous container 42 of a prior art.

FIG. 30 shows a luminous container of a prior art.

FIGS. 31 to 34 show luminous vessels for high pressure discharge lamps of so called HPS type.

A current through conductors 5 are supported through a plug 40 made of alumina on the inner surface 42*b* of a straight tube-shaped luminous vessel 42 at both ends 42, respectively. The conductor 5 and plug 40 are sealed with sealing material 6.

Figure 31:
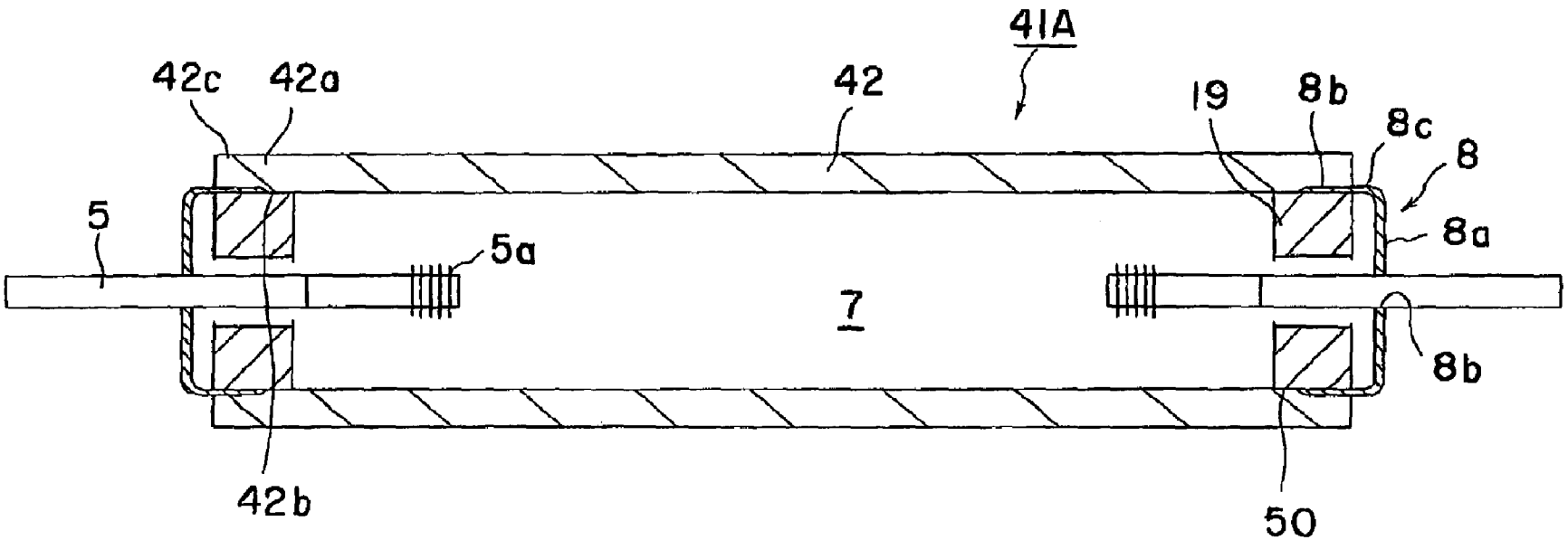
FIG. 31 is a cross sectional view schematically showing a luminous container 41A of HPS type.

According to a luminous container 41A shown in FIG. 31, a cylindrical luminous vessel 42 made of a brittle material functions as an outer supporting body at the end 42*a* of the luminous vessel 42, and an inner supporting body 19 made of a brittle material has the analogous shape as the outer supporting body. A clamped portion 8*b* of the plate-shaped metal piece 8 is clamped and fixed between the luminous container 42 and inner supporting body 19. The plate-shaped metal piece 8 functions as a supporting member for the current through conductor 5 and electrode 5*a*. Non-clamped portions 8*a* and 8*c* are protruded from the brittle material, and the clamped portion 8*b* is embedded in the brittle material. Both faces of the clamped portion 8*b* is pressed to deform the clamped portion 8*b* and to relax the stress due to the difference of physical properties of the brittle material and metal. The luminous vessel 42 and inner supporting body 19 directly contact each other direct under the clamped portion 8*b* along surface 50.

Figure 32:
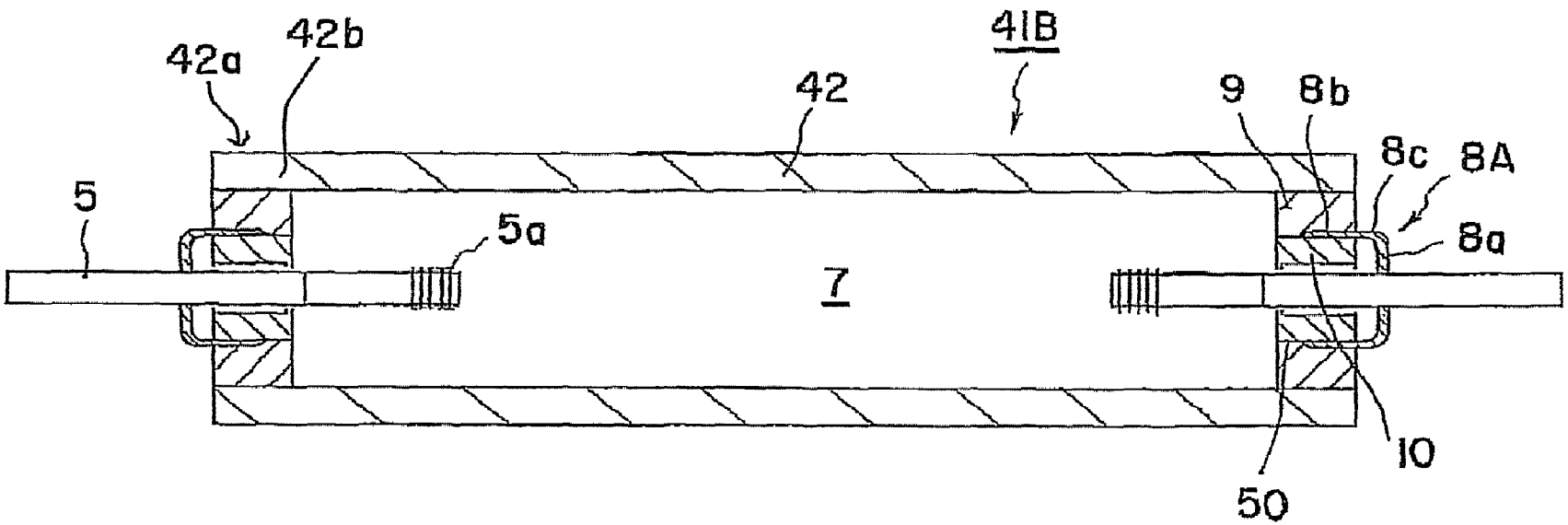
FIG. 32 is a cross sectional view schematically showing a luminous container 41B of HPS type.

At the tip end of a luminous vessel 41B shown in FIG. 32, on the side of the inner surface 42*b* of the end portion 42*a* of a cylindrical luminous vessel 42 made of brittle material, a cylindrical outer supporting body 9 made of the same brittle material is provided. A cylindrical inner supporting body 10 is provided inside of the outer supporting body 9. The clamped portion 8*b* of a cap-like plate-shaped metal piece 8A is clamped and fixed between the outer supporting body 9 and inner supporting body 10.

Non-clamped portions 8*a* and 8*c* of the electrode supporting body 8A composed of a plate-shaped metal piece are protruded from the brittle material, and the clamped portion 8*b* is embedded in the brittle material. Both faces of the clamped portion 8*b* is pressed by the brittle material radially to deform the clamped portion 8*b* and to relax the stress due to the difference of physical properties of the brittle material and metal. The outer supporting body 9 and inner supporting body 10 directly contact each other direct under the clamped portion along surface 50.

Figure 33:
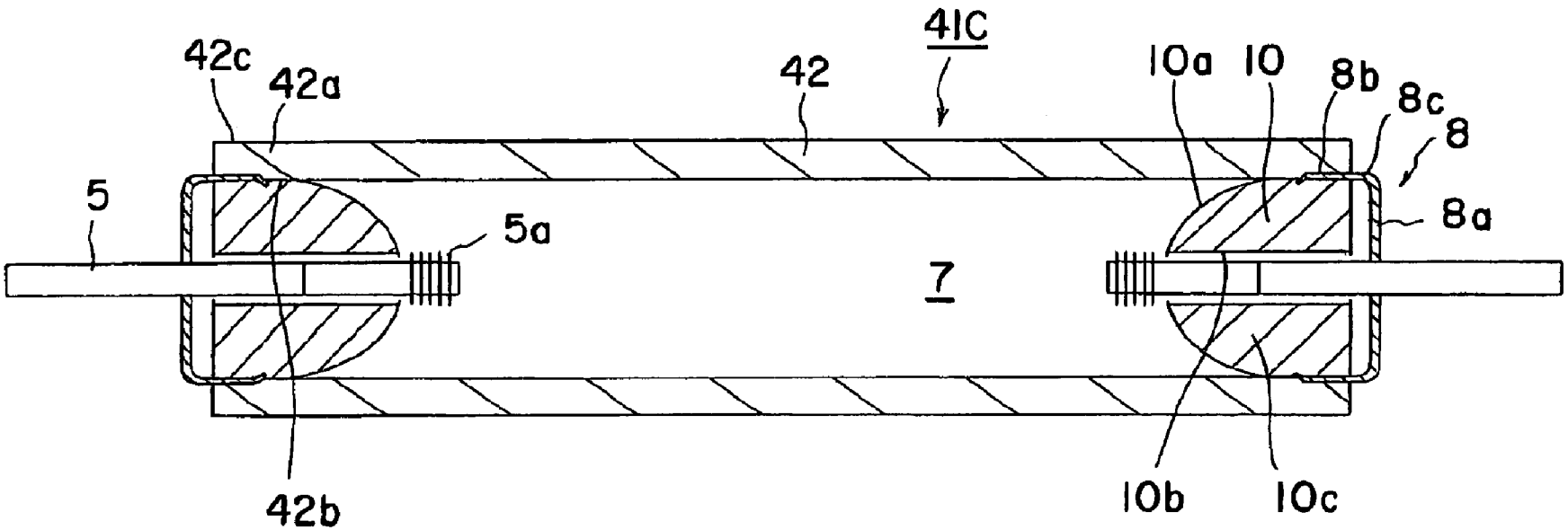
FIG. 33 is a cross sectional view schematically showing an assembly of a luminous container 41C of HPS type.

According to a luminous container 41C shown in FIG. 33, a cylindrical luminous vessel 42 made of a brittle material functions as an outer supporting body, and the clamped portion 8*b* of the electrode supporting member 8 is clamped between the inner surface 42*b* of the luminous vessel 42 and the inner supporting body 10 made of brittle material.

According to the present example, a protrusion 10*a* is formed in the inner supporting body 10 toward the center of the inner space 7. The inner surface 10*b* of the protrusion 10*a* substantially has the same diameter and functions as a guide for protecting the electrode conducting portion 5 and electrode 5*a*. The outer surface 10*a* of the protrusion 10 is shaped to form a curved and inclined face along the angle of radiation of light to avoid the interference of the radiation from the luminous vessel. Such protrusion prevents the deformation and corrosion of electrode conducting portion 5 due to the luminous substance during light luminescence. It is further possible to reduce the volume not utilized for the light luminescence in the luminous vessel and to reduce the amount of luminous substance sealed in the luminous vessel.

According to the present example, the diameter of winding part 5*a* of a coil made of tungsten or the like at the tip end of the electrode is larger than the inner diameter of the inner supporting body 10, so that the electrode and current through conductor are integrated with the luminous vessel while they are inserted into the hole of the inner supporting body 10 in advance. Since the electrode supporting member and current through conductor are not sealed in air-tight manner, luminous substance is supplied into the luminous vessel through a clearance of the electrode supporting member and current through conductor. They are then sealed in air-tight manner. It is thus possible to complete the assembly of the luminous container.

Figure 34:
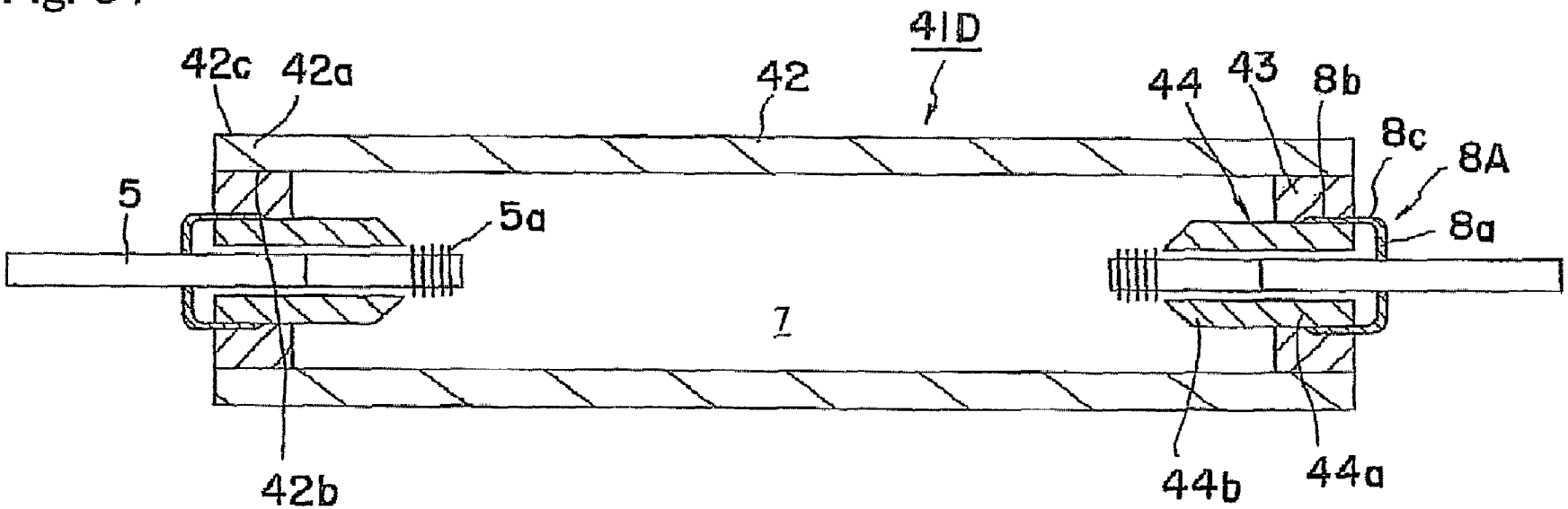
FIG. 34 is a cross sectional view schematically showing a luminous container 41D of HPS type.

At the tip end of a luminous vessel 41D shown in FIG. 34, inside of a cylindrical outer supporting body 43 made of brittle material, a cylindrical inner supporting body 44 made of the same brittle material is provided. The clamped portion 8*b* of an electrode supporting member 8A composed of a plate-shaped metal piece is clamped and fixed between the outer supporting body 43 and the cylindrical part 44*a* of the inner supporting body 44. The end portion 42*a* of a cylindrical luminous vessel 42 made of brittle material is further provided outside of the outer supporting body 43 to assemble a luminous container 41D. 42*c* represents an edge of the outer supporting body.

According to the present example, a protrusion 44*b* is formed toward the center of the inner space 7 in the supporting body 44. The inner surface of the protrusion 44*b* has a substantially constant diameter and functions as a guide for protecting the current through conductor 5 and electrode 5*a*.

According to the present invention, an adhesive may also be used on the outside of the electrode supporting member composed of a plate-shaped metal piece. Although the kind of the adhesive is not particularly limited, so called frit glass is preferred, and a glass composition of Al2O3-Dy2O3-SiO2 system and that further containing nitrogen atom are most preferred.

When the luminous vessel is made of sapphire (alumina single crystal) or translucent alumina material consisting mainly of sapphire, the longitudinal axis of the tube shaped luminous vessel corresponds to the c-axis of sapphire. It is preferred that the tube axis of the luminous vessel and the c-axis are intersected at an angle of 10° or lower. It is thus possible to considerably reduce the incidence of cracks in sapphire along and near the interface between the luminous vessel and the inner or outer supporting body fixed at the end of the luminous vessel, because the distribution of the thermal stress may be made symmetrical with respect to the axis. On the viewpoint, the angle of the c-axis of sapphire forming the luminous vessel and the tube axis of the luminous vessel may more preferably be 5° or lower.

Further, the electrode supporting member composed of the plate-shaped metal piece may substantially have a shape of a cap, as described above. Such cap may be produced by drawing or the like, although the production method is not particularly limited. However, if drawing process is applied for processing a rolled body for example, embrittlement may progress during the heat treatment in a direction perpendicular to the direction of rolling. Attention is required on this point during the drawing process. Variations of the metal members may be appropriately adjusted depending on the design of the bonded body.

For example, at the air-tight sealing part at the end portion of a high pressure sodium lamp, Nb or the like can be used. If a soft metal such as Nb is used, the thickness of the metal is designed to be thicker for avoiding the deformation under high pressure. It is further considered to provide a pushing part (of brittle material portion) for avoiding the over deformation of metal due to high pressure and temperature. However, the sintering is needed to be performed under inert atmosphere (including vacuum) for preventing the embrittlement of Nb.

When an Nb thin plate and Nb current conductor are used, the sealing may be performed by pressure bonding or mechanical sealing such as fitting (so called, guillotine method). When the metal part of the bonded body is near an auxiliary electrode (winding, printing by metalizing) on the outer surface of a luminous vessel, it is necessary to provide an insulating means for preventing shortage near the metal part of the bonded body. Alternatively, on the contrary, an appropriate electrical circuit may be provided in the metal part and auxiliary electrode portion.

When the luminous vessel is made of quartz, sintered quartz may be used for the outer supporting body. After the sintering, it may be necessary to apply a technique of reducing foams (the atmosphere may most preferably be vacuum, although reducing atmosphere may be used). Further, the outer supporting body may be made of quartz glass softened by heating at high temperature for press bonding from the outside and sealing.

In the case of a ceramic metal halide lamp in general, the shape of a luminous vessel is divided into a part for inserting an electrode of the luminous vessel and a luminous main portion having a larger diameter. The inventive bonded portion may preferably be used as the end portion of a narrower tube part, so that a frit sealing structure can be alleviated to improve the heat resistance and the bonded portion (sealing portion) can be used at a higher temperature region, compared with a prior art. As a result, although an elongate narrower part has been necessary for lowering the temperature by drawing thermal flux in a prior design, such capillary may be omitted or the length may be made smaller according to the present invention to provide a compact luminous vessel. The design of an outer lamp may be selected among wider variations and the functionality and appearance can be made excellent. The amount of luminous substance can be reduced to manufacture the luminous vessel more economically.

Further, when a high level of current is supplied into the electrode during on-time in a prior art, a large amount of heat would be generated in the current through conductor sealed with a frit. The temperature of the current through conductor is thus elevated to which generates thermal stress due to the difference of thermal expansion of the frit and alumina and results in cracks in the frit sealing part.

On the contrary, according to the present invention, the current through conductor does not directly contact ceramic material having the different thermal expansion coefficient which avoids thermal stress between the current through conductor and the ceramic material even when a large current is applied to the electrode. The heat generated in the current through conductor due to the supply of the large current is conducted to the thin electrode supporting member, then dispersed in the clamped portion embedded in brittle material and absorbed into the brittle material. The stress generated in the process is smaller than that generated in the prior frit sealed part. Even when a large stress would be generated, such stress can be absorbed with a very small deformation of the clamped portion embedded in the brittle material. It becomes thus possible to supply a large current during on-time or select the wire diameter of the current through conductor without particular limitations.

In the case of a ceramic halide lamp for an automobile, the end portion not contributing to the luminescence is needed to be made smaller. Further, the size of the luminous vessel may be preferably be smaller for reducing the overall thermal capacity. On the side of a circuit for supplying electric power, the size of the luminous vessel can be lowered so that the luminescence (temperature) of the vessel can respond with respect to the power input in a short time to remove the need for excessive starting power. At the same time, it means that the temperature distribution in the luminous vessel can be reduced. That means that unnecessary thermal stress on a ceramic material against thermal shock can be avoided which results in improvement of the reliability of the luminous vessel. For example, high strength PCA luminous vessel material may be advantageously applied for reducing the size of the luminous vessel. PCA has a very small average grain diameter (for example 10 μm or smaller) even after the sintering so as to result in a high strength of 2 or more times of that of the vessel made of a conventional material.

Although the vessel may be produced by means of methods not particularly limited, methods using an inner core such as gel cast molding are preferred, because the inner shape of the luminous vessel can be selected without limitation. Further, when ceramic materials which can be sintered at a low temperature is used for the luminous vessel or outer ring, the embrittlement of the metal part can be prevented to provide the luminous vessel with excellent reliability. The luminous substances may be composed of different kinds of rare earth elements other than prior Sc—Na system in response to the corrosion state of the ceramic vessel.

Further, in the luminous vessel, when Mo or Nb is used for the current through conductor or electrode supporting portion, the turning-on without an outer lamp is difficult. In the case of no outer lamp, coating the surface with a thin metal film may be applied as the solution. The coating with glass or like may be also applied. In the case of metal coating, it is necessary to prevent the exposure of Mo to air due to the interdiffusion of metals. In the case of mercury-free luminous vessel, the metal part of Pt system may be used. The turning-on without an outer lamp in air is possible in the case of pure Pt. Further, a small clearance may be provided between the inner diameter of the (inner) ceramic tube positioned near the electrode inserting part and the inserted electrode for preventing the blacklash of the electrode assembly and for improving the positioning accuracy of the electrode.

Further, when a welded part is distant from the pressure bonded part, fine welding such as laser welding is not necessary this widens the range of welding means. Further, when the metal portion is not cap-shaped, the pipe-shaped portion of the metal member may be welded with the bottom plate part. Further, the bottom plate part and electrode may be welded in advance and then welded with the metal pipe-shaped part.

Further, when the electrode is to be conducted with an outer lead, it is possible to assure the conduction through a part (laterally) other than the direction of the tube axis, because the metal member as well as the electrode are made of a conductor. Further, in addition to the welding, soldering and mechanical fitting, the conduction may be assured by elongating a part of the plate-shaped metal piece to the outside for use as a part of a lead. Further, a part of the plate-shaped metal piece is bent as "U" character for functioning as a part for absorbing the shock and thermal expansion from the outside in use. As described above, the conducting part may be designed without limitation to provide excellent functionality and appearance.

The method of manufacturing the luminous vessel is not particularly limited. The shell portion of the luminous vessel may be molded by (1) extrusion, slurry casting or injection molding so that two parts for the luminous vessel is molded separately, and the molded bodies may be joined before the dewaxing and sintered to integrate them. Further, the shell part of the luminous vessel may be molded (2) by means of lost wax process such as gel cast molding to provide an end portion sealing structure whose design of the shell part is not limited.

Further, in a metal halide lamp, Mo, W, Re or the like has been used on the viewpoint of corrosion resistance. In a high pressure sodium lamp, Nb may be applied for the metal member. Further, as described above, Nb may be applied in a super high pressure mercury lamp.

The luminous bodies may be sealed as follows to provide a discharge lamp.

(1) Metal Halide Lamp (Illumination for General Lighting)

Hg (not essential component), the iodide of a metal (Na, rare earth element or the like) are supplied through a hole of a metal cap (metal cap itself may have a guiding part) made of Mo in Ar atmosphere of 50 to 200 mbar and Mo or W electrode is then inserted and sealed by welding such as TIG welding or laser welding.

(2) Metal Halide Lamp (Automobile Use, Point Light Source)

Metal iodide and Hg (not essential component) are sealed as described in (1). 7 to 20 bar of Xe is used as a starter gas depending on the conditions. Particularly in the case of the present invention, it is possible to completely prevent the evaporation of luminous substances such as a starter gas, because the sealing can be completed in a very short time and at a low temperature. The material of the shell part may be conventional translucent alumina and may preferably be YAG, sapphire, polycrystalline alumina having a grain diameter of 10 μm or smaller or the like having a high linear transmittance.

(3) High Pressure Na Lamp

Nb is used for the metal cap. The electrode is made of Mo, W or Nb welded with each other. The luminous substance may be Na—Hg amalgum and a starter gas such as Ar or the like or Xe in the case of no Hg used. Particularly when an auxiliary electrode is used on the surface of the tube (irrespective of the kind of the electrode such as coil winding, printing by metallizing or the like), an insulating means may be provided on the auxiliary electrode depending on the cases for preventing the shortcut of the electrode supporting member or the like and auxiliary electrode.

(4) Super High Pressure Mercury Lamp

The material of the shell part may preferably be YAG, sapphire or polycrystalline alumina having a grain diameter of 10 μm or lower having a high linear transmittance. The luminous substances include Hg and Br. Nb as well as Mo and W may be used for the metal cap, and the welding method is the same as described above.

The discharge lamp obtained according to the procedures described above may be turned on by means of an appropriate igniter or ballast.

According to each of the first, second and third aspects of the present invention, a coating composed of a metal or mixture of a metal and ceramics may be provided on the outer surface of the luminous vessel as an optical masking means. The masking means a shading film. For example, in the case of a head lamp for automobile, a shading film is provided on the outer surface of the luminous vessel for controlling the direction of the light, so that the lamp of the opposing automobile does not cause glare (for example for preventing the light directed toward UPPER direction). Such light shading film is disclosed in Japanese Patent publications 2004-149640A, 2004-163911A and 2004-134219A.

A metal forming the shading film is not particularly limited, and may preferably be a metal selected from the group consisting of tungsten, molybdenum, rhenium or the alloys thereof. Further, when mixture of a metal and ceramics is used, the ceramics may preferably contain a constituent of the luminous vessel. Such ceramics was described above as the materials of the luminous vessel. Further, the shading film may be made by applying paste.

EXAMPLES

Example 1

A luminous vessel 1A shown in FIG. 2 was produced.

Specifically, a molybdenum plate was subjected to deep drawing to produce a cap-shaped electrode supporting member 8. A cover 8*a* had a diameter of 2 mm and a thickness of 200 mm. Further, the electrode supporting member had a cylindrical portion having a length of 3 mm and a clamped portion having a thickness of 100 μm. At the curved portion 8*c*, the thickness was gradually reduced toward the clamped portion. The tip end of the clamped portion 8*b* has a shape of a wedge. A through hole 8*d* having a diameter of 500 μm is formed in the cover portion 8*a*.

Prepared was a tube 3 made of high purity alumina and having an outer diameter of 2 mm, an inner diameter of 0.6 mm and a length of 5 mm which may be inserted inside of the electrode supporting member 8. The tube was used as an inner supporting body and covered with the electrode supporting member 8.

Prepared was a tube-shaped molded body 2 (molded at a pressure of 1500 kg/cm$^2$) for luminous vessel, molded with a dry bag molding machine, made of high purity alumina and having an inner diameter of 2.1 mm, an outer diameter of 4 mm and a length of 20 mm. The molded body 2 was used as an outer supporting body. As shown in FIG. 3 (*a*), the inner supporting body 3 covered with the electrode supporting member 8 was inserted into each side of the molded body for luminous vessel to provide an assembly, which was then sintered in hydrogen atmosphere at 1800° C. to produce a luminous container (FIG. 3 (*b*)).

Example 2

A structure shown in FIG. 4 was produced.

Specifically, a molybdenum plate was subjected to deep drawing to produce a cap-shaped electrode supporting member 8A. A cover portion 8*a* had a diameter of 2 mm and a thickness of 200 mm. Further, the electrode supporting member has a cylindrical portion having a length of 3 mm and a clamped portion 8*b* having a thickness of 100 μm. At the curved portion 8*c*, the thickness was gradually reduced toward the clamped portion. The tip end of the clamped portion 8*b* had a shape of a wedge. A through hole 8*d* having a diameter of 500 μm was formed in the cover portion 8*a*.

Prepared was a tube-shaped molded body 10 made of high purity alumina and having an outer diameter of 2 mm, an inner diameter of 0.6 mm and a length of 5 mm which can be inserted inside as the electrode supporting member 8A. The inner molded body 10 was covered with the electrode supporting member 8A. Further, the inner diameter of the inner supporting body 10 is smaller than the diameter of the wound portion 5*a* of a tungsten coil at the tip end of the electrode, so that the current through conductor 5 and electrode 5*a* cannot be inserted into the luminous vessel from the outside. The current through conductor 5 (with a diameter of 0.5 mm and the tip end portion has a diameter of 0.8 mm) was inserted into the electrode supporting member in advance.

Prepared was a tube-shaped molded body (molded at a pressure of 1000 kg/cm$^2$) molded with a press machine, made of high purity alumina and having an inner diameter of 2.1 mm, an outer diameter of 15 mm and a length of 6.5 mm. The molded body was used as an outer supporting body 9. The inner supporting body 10 assembled with the metal cap and current through conductor and electrode was inserted into the tube-shaped molded body to produce an assembly, which was then sintered in hydrogen atmosphere at 1750° C. to produce a part for fixing electrode of a luminous vessel with the current through conductor and electrode inserted therein in advance. The diameter of the finished part was 12 mm in outer diameter and 5 mm in length. The cylindrical clamped portion 8*b* of the electrode supporting member 8A was pressed and fixed with the outer supporting body 9 of alumina and inner supporting body 10. The cover portion 8*a* of the electrode supporting member 8A was exposed to the end of the supporting body as the non-clamped portion. An end part was thus obtained.

Further prepared was a tube-shaped molded body 2 (molded at a pressure of 1500 kg/cm$^2$) molded with a dry bag molding machine, made of high purity alumina and having an inner diameter of 12.5 mm, an outer diameter of 15.5 mm and a length of 50 mm. The end part was inserted into each side of the molded body to provide an assembly, which was then sintered in hydrogen atmosphere at 1800° C. to produce a luminous container. FIG. 4 shows an assembly for luminous container having the electrode and current through conductor inserted therein.

Example 3

A luminous vessel 1C shown in FIG. 5 was produced.

Specifically, an electrode supporting member 8 was prepared according to the same procedure as the example 1. However, the diameter of the electrode supporting member 8 was 4 mm, the length of the cylindrical portion was 4 mm, the thickness of the cover portion 8*a* was 200 μm, and the thickness of the clamped portion 8*b* was 100 μm. A hole 8*d* having a diameter of 500 μm was formed in the cover portion 8*a*.

Prepared was a tube made of high purity alumina and having a whole length of 10 mm was prepared. The tube has a protrusion 10*a* having a cylindrical base with an outer diameter of 4 mm, an inner diameter of 0.6 mm and a length of 5 mm and a part whose outer diameter was gradually lowered toward the direction of the length. The tube was used as the inner supporting body 10. The inner supporting body 10 was covered with the electrode supporting member 8.

Prepared was a tube-shaped molded body 2 (molded at a pressure of 1500 kg/cm$^2$), molded with a dry bag molding machine, made of high purity alumina and having an inner diameter of 4.2 mm, an outer diameter of 7 mm and a length of 45 mm. The molded body was used as an outer supporting body 2. The inner supporting body 10 covered with the electrode supporting member 8 was inserted into each side of the molded body 10 to provide an assembly, which was then sintered in hydrogen atmosphere at 1800° C. to produce a luminous container.

FIG. 5 also shows a luminous vessel with the current through conductor 5 and electrode 5*a* inserted therein.

The protrusion 10*c* of the inner supporting body 10 having the above shape supports the side face of a substantial portion of the current through conductor 5, so that the positioning error of the electrode axis was small, the dimensional accuracy of the distance between the electrodes was excellent and the corrosion due to luminous substance corrosive to the current through conductor and electrode can be reduced. Further, it is expected that the inner volume of the luminous vessel can be reduced and the weight of the luminous substance sealed in the luminous vessel can be reduced.

Example 4

A luminous container 1D shown in FIG. 6 was produced.

Specifically, it was prepared an electrode supporting member 8A having the same dimensions and shape as those of the example 1.

A tube composed of a high purity alumina sintered body having an outer diameter of 2 mm, an inner diameter of 0.6 mm and a length of 10 mm was prepared and used as the inner supporting body 15. The inner supporting body 15 was covered with the electrode supporting member 8A.

A molded body made of high purity alumina having the whole length of 12.5 mm with a 6.5 mm portion in length having an inner diameter of 2.1 mm and an outer diameter of 15 mm and a tapered portion whose outer diameter was gradually reduced. The molded body was used as an outer supporting body 14. The inner supporting body 15 covered with a metal cap was inserted to provide an assembly, which was then sintered at 1750° C. in hydrogen atmosphere to produce a part for fixing the electrode and current through conductor of a luminous vessel. According to the finished dimensions, the portion had an outer diameter of 12 mm had a length of 5 mm, and a protrusion whose outer diameter was reduced and tapered had a whole length of 10 mm. The cylindrical portion of the electrode supporting member 8 was used as the clamped portion 8*b* pressed and fixed with the outer and inner supporting bodies of alumina. An end part was thus obtained whose cover portion 8*a* of the electrode supporting member 8 was exposed to the end of the supporting body as the non-clamped portion.

Further prepared was a tube-shaped molded body (at a molding pressure of 1500 kg/cm$^2$) molded by a dry bag molding machine, made of high purity alumina and having an inner diameter of 12.5 mm, an outer diameter of 15.5 mm and a length of 50 mm. The end part was inserted into each of the ends of the molded body 2 to produce an assembly, which was then sintered at 1800° C. in hydrogen atmosphere to produce a luminous container 1D. FIG. 6 further shows the luminous container with the current through conductor 5 and electrode 5*a* inserted therein.

The protrusions 14*a* and 15*a* composed of the inner and outer supporting bodies support the side face of a substantial portion of the current through conductor 5. It is thus possible to reduce the positioning error of the electrode axis, to improve the dimensional precision of the distance between the electrodes, and to reduce the corrosion of the current through conductor by corrosive luminous substance. It is further expected that the content of the luminous vessel and the weight of the luminous substance sealed in the luminous vessel can be reduced.

By applying the structure as shown in FIG. 6, it can be used a cap-like electrode supporting member 8A having a diameter smaller than the inner diameter of the luminous vessel 2 by the thickness of the outer supporting body 14. Since the inner pressure of the luminous vessel 2 is higher than atmospheric pressure, the diameter of the electrode supporting member 8A may preferably be made smaller so that the stress generated in the electrode supporting member 8A can be advantageously reduced. It is further possible to considerably reduce the contact area of the electrode supporting member 8A and corrosive luminous substance in the inner space 7 to effectively reduce the corrosion of the electrode supporting member 8A.

Example 5

A luminous vessel 1E shown in FIG. 7 was produced. Specifically, the electrode supporting member 8 having the same dimension and shape as those in the example 1 was prepared.

Prepared was a translucent alumina luminous vessel (made of alumina single crystal such as sapphire), which can be inserted into the electrode supporting member 8, having an outer diameter of 2 mm, an inner diameter of 0.6 mm and a length of 20 mm. The vessel was used as the inner supporting body which was covered with the electrode supporting member 8.

Prepared was a ring-shaped molded body (molded at a pressure of 1000 kg/cm$^2$) molded with a press molding machine, made of high purity alumina and having an inner diameter of 2.1 mm, an outer diameter of 6 mm and a length of 6.5 mm. The molded body was used as an outer supporting body 13. Each end portion of the luminous vessel 2 covered with the electrode supporting member was covered with the outer supporting body 13 to provide an assembly, which was sintered at 1800° C. in hydrogen atmosphere to produce a luminous container. FIG. 7 further shows the luminous container with the current through conductor 5 and electrode 5*a* inserted therein.

Example 6

A luminous vessel 1F shown in FIG. 8 was produced. Specifically, the electrode supporting member 8A having the same dimension and shape as those in the example 1 was prepared.

Prepared was a tube made of high purity alumina sintered body and having an outer diameter of 2 mm, an inner diameter of 0.6 mm and a length of 5 mm. The tube was used as the inner supporting body 17 which was covered with the electrode supporting member 8A.

In addition, an outer supporting body 16 was molded by a press molding machine. The molded body had a base portion 16*a* and a protrusion 16*b*. The protrusion 16*b* had an inner diameter of 2.1 mm and a length of 6.5 mm. The molded body 16 (molded at a pressure of 1000 kg/cm$^2$) was made of high purity alumina. The molded body 16 was used as an outer supporting body. The base portion 16*a* covered the inner supporting body 17 which was covered with the electrode supporting member 8A. A translucent alumina tube 2 (mainly consisting of alumina single crystal such as sapphire) having an outer diameter of 4 mm, a thickness of 1 mm and a length of 20 mm was inserted into the protrusion 16*b* to produce an assembly, which was then sintered at 1800° C. in hydrogen atmosphere to produce a luminous container. FIG. 8 further shows the luminous container with the current through conductor 5 and electrode 5*a* inserted therein.

Example 7

A luminous vessel 1G shown in FIG. 9 was produced.

Specifically, an electrode supporting member 8A having the same dimensions and shape as those of the example 1 was prepared according to the same procedure as the example 1.

Prepared was an inner supporting body 17A of high purity alumina which can be inserted into the electrode supporting member 8A. The inner supporting body 17A was composed of a high purity alumina sintered body (of a purity of 99.9 percent) having a base portion 17*d* with an outer diameter of 2 mm, an inner diameter of 0.6 mm and a length of 5 mm and a protrusion 17*a* with a length of 5 mm whose outer diameter is gradually reduced from 2 mm toward the tip end. The inner supporting body 17A was covered with a metal cap 8A.

In addition, an outer supporting body 16 was prepared with a press molding machine. The outer supporting body 16 has a base portion 16*a* with an inner diameter of 2.1 mm and a length of 6.5 mm and a protrusion 16*b* with an inner diameter of 4.1 mm and a length of 6.5 mm. The molded body 16 made of high purity alumina was prepared (molded at a pressure of 1000 kg/cm$^2$) and was used as an outer supporting body, into which the inner supporting body 17A was covered with the electrode supporting member 8A and was inserted. A translucent alumina luminous vessel 2 (mainly consisting of alumina single crystal such as sapphire) with an outer diameter of 4 mm, a thickness of 1 mm and a length of 20 mm was inserted into the protrusion 16*b* to provide an assembly, which was then sintered in hydrogen atmosphere at 1800° C. to produce a luminous container. FIG. 9 also shows the luminous container with the current through conductor 5 and electrode 5*a* inserted therein.

The protrusion 17*a* of the inner supporting body having the above shape supports the side face of a substantial portion of the current through conductor, so that the positioning error of the electrode axis was small, the dimensional accuracy of the distance between the electrodes was excellent and the corrosion due to luminous substance corrosive to the current through conductor can be reduced. Further, it is expected that the inner volume of the luminous vessel can be reduced and the weight of the luminous substance sealed in the luminous vessel can be reduced. By applying the structure as shown in FIG. 9, it can be used a cap-like electrode supporting member 8A having a diameter smaller than the inner diameter of the luminous vessel 2 by the thickness of the outer supporting body 16. Since the inner pressure of the luminous vessel 2 is higher than atmospheric pressure, the diameter of the electrode supporting member 8A may preferably be made smaller so that the stress generated in the electrode supporting member 8A can be advantageously reduced. It is further possible to considerably reduce the contact area of the electrode supporting member 8A and corrosive luminous substance in the inner space of the luminous vessel to effectively reduce the corrosion of the electrode supporting member 8A.

The advantageous effects of the present sealing structure will be described below.

(1. Example of Reducing the Deviation of the Sealing Article: in the Case of Sealing a High Pressure Luminous Substance for Automobile Use or the Like)

A ceramic luminous container of a prior art (frit seal) of 35 W and luminous containers of the examples 1 to 7 each having the same watt number were subjected to a test of sealing Xe corresponding to 15 bar. Xe was condensed at a low temperature. n=100 sealing articles were broken in a vacuum container at room temperature having a specific volume for each of the examples and the inner pressure (partial pressure of Xe) of each container was measured for the evaluation.

As a result, according to the article of a prior art, the average of n=100 was 8 atoms. On the contrary, when each of the luminous containers of the examples 1 to 7 was used, the average corresponded to 14.5 atoms.

(2. Air-Tightness of Sealing)

n=30 of the sealed luminous vessels according to each of the examples 1 to 7 were vacuum sealed in a quartz tube and held at 900° C. for 48 hours. A Tesla coil was then used to generate discharge in the tube. "NG" was assigned when luminescence was observed in a quartz outer lamp, and "OK" was assigned when luminescence was not observed in the outer lamp. According to the article of a prior art, n=25/30 were assigned as "NG", In the case of each of the luminous containers of the examples 1 to 7, no "NG" articles were observed in each example.

(Examples of Providing a Masking Material)

In each of the luminous containers of the examples 1 to 7, a shade film functioning as a masking material was formed on a predetermined position of the outer surface of the luminous vessel. Specifically, the luminous vessel was made of translucent alumina. The paste composition was made W/alumina of 60/40 volume percent. 2 to 10 weight percent of ethyl cellulose and an appropriate amount of butyl carbitol acetate were added as binders to the paste to obtain viscous paste. The paste was applied onto the dewaxed calcined body of each example described earlier and dried at 90° C. for 2 hours, and then sintered simultaneously with the luminous vessel. The masking material realized optional light control design.

The invention claimed is:

1. A luminous container comprising an electrode supporting member comprising a pipe-shaped metal piece, a tube-shaped outer supporting body comprising a brittle material, and a pipe-shaped inner supporting body comprising a brittle material and provided inside of said outer supporting body, said piped-shaped metal piece comprising a clamped portion provided between and pressed with said outer and inner supporting bodies and a non-clamped portion not clamped with said outer and inner supporting bodies, wherein a stress generated along an interface where said clamped portion and each of said outer and inner supporting bodies contact each other is relaxed by deformation of said clamped portion of said pipe-shaped metal piece, and wherein said outer supporting body and said clamped portion directly contact each other, said clamped portion and said inner supporting body directly contact each other and said outer supporting body and inner supporting body directly contact each other throughout an entire circumference of the inner supporting body.

2. The luminous container of claim 1, wherein said tube-shaped outer supporting body is a luminous vessel.

3. The luminous vessel of claim 2, wherein said inner supporting body has a thickness lowering toward the center of said luminous vessel.

4. The luminous container of claim 1, further comprising a luminous vessel joined to said outer supporting body.

5. The luminous container of claim 4, wherein said outer supporting body is clamped outside of said luminous vessel.

6. The luminous container of claim 5, wherein the total thickness of said outer and inner supporting bodies is reduced toward the center of said luminous vessel.

7. The luminous container of claim 4, wherein said outer supporting body presses the outer surface of the end portion of said luminous vessel, and wherein said inner supporting body is provided inside of said outer supporting body.

8. The luminous container of claim 2, wherein said luminous vessel has a shape of a straight tube.

9. The luminous container of claim 2, wherein said luminous vessel is expanded toward the center of said luminous vessel.

10. The luminous container of claim 2, wherein said luminous vessel comprises a joined body of a plurality of molded bodies.

11. The luminous container of claim 1, wherein said clamped portion has a tip end of a shape of a knife edge, a C-plane or an R-plane.

12. The luminous container of claim 1, wherein said brittle material is selected from the group consisting of a glass, a ceramics and a cermet.

13. The luminous container of claim 1, wherein said clamped portion has a thickness of 20 to 1000 μm.

14. The luminous container of claim 2, further comprising an optical masking means comprising a film made of a metal or a mixture of a metal and a ceramics on the outer surface of said luminous vessel.

15. The luminous container of claim 14, wherein said metal is selected from the group consisting of tungsten, molybdenum, rhenium and the alloys thereof.

16. The luminous container of claim 14, wherein said ceramics comprises a constituent of said luminous vessel.

17. The luminous container of claim 1, wherein said electrode supporting member has a seamless structure.

18. The luminous container of claim 1, wherein said clamped portion of said electrode supporting member has a shape of a seamless tube.

19. An assembly for a luminous container, comprising said luminous container of claim 1, wherein said electrode supporting members are fixed onto one and the other ends of said luminous container, respectively, a current through conductor is inserted into said electrode supporting member in advance, said electrode is contained in said luminous container in advance, and said electrode supporting member and said current through conductor are not sealed in air tight manner in at least one of said one and the other ends.

20. A luminous container for a high pressure discharge lamp, comprising said luminous container of claim 1, and an electrode and a current through conductor supported with said electrode supporting member.

21. A luminous container comprising a tube-shaped outer supporting body comprising a luminous vessel made of a brittle material, a pipe-shaped inner supporting body provided inside of said outer supporting body and made of a brittle material, and a pipe-shaped metal piece provided between said outer and inner supporting bodies, wherein the entire outer supporting body is positioned radially outwardly with respect to the inner supporting body, said outer supporting body and said metal piece directly contact each other, said metal piece and said inner supporting body directly contact each other and said outer supporting body and said inner supporting body directly contact each other throughout an entire circumference of the inner supporting body, and wherein said metal piece functions as an electrode supporting member.

22. The luminous container of claim 21, wherein the difference of thermal expansion coefficients of said outer and inner supporting bodies is 2 ppm/K or lower.

23. The luminous container of claim 21, wherein said plate-shaped metal piece comprises a non-clamped portion comprising a seamless cover portion, wherein a through hole is provided in said cover portion for inserting a current through conductor and an electrode.

24. The luminous container of claim 21, wherein said non-clamped portion comprises a guide for adjusting the concentricity of a current through conductor and an electrode and a capillary portion having a length capable of being a connecting end.

25. An assembly for a luminous container, comprising said luminous container of claim 21, wherein said electrode supporting members are fixed onto one and the other ends of said luminous container, respectively, a current through conductor is inserted into said electrode supporting member in advance, said electrode is contained in said luminous container in advance, and said electrode supporting member and said current through conductor are not sealed in air tight manner in at least one of said one and the other ends.

26. A luminous container for a high pressure discharge lamp, comprising said luminous container of claim 21, and an electrode and a current through conductor supported with said electrode supporting member.

27. A luminous container comprising a tube-shaped inner supporting body comprising a luminous vessel made of a brittle material, a pipe-shaped outer supporting body provided outside of said inner supporting body and made of a brittle material, and a pipe-shaped metal piece provided between said inner and outer supporting bodies, wherein the entire outer supporting body is positioned radially outwardly with respect to the inner supporting body, said inner supporting body and said metal piece directly contact each other, said metal piece and said outer supporting body directly contact each other and said outer supporting body and said inner supporting body directly contact each other throughout an entire circumference of the inner supporting body, and wherein said metal piece functions as an electrode supporting member.

28. The luminous container of claim 27, wherein the difference of thermal expansion coefficients of said outer and inner supporting bodies is 2 ppm/K or lower.

29. The luminous container of claim 27, wherein said plate-shaped metal piece comprises a non-clamped portion comprising a seamless cover portion, wherein a through hole is provided in said cover portion for inserting a current through conductor and an electrode.

30. The luminous container of claim 29, wherein said non-clamped portion comprises a guide for adjusting the concentricity of a current through conductor and an electrode and a capillary portion having a length capable of being a connecting end.

31. An assembly for a luminous container, comprising said luminous container of claim 27, wherein said electrode supporting members are fixed onto one and the other ends of said luminous container, respectively, a current through conductor is inserted into said electrode supporting member in advance, said electrode is contained in said luminous container in advance, and said electrode supporting member and said current through conductor are not sealed in air tight manner in at least one of said one and the other ends.

32. A luminous container for a high pressure discharge lamp, comprising said luminous container of claim 27, and an electrode and a current through conductor supported with said electrode supporting member.

* * * * *